US010081030B2

(12) United States Patent
Fuller et al.

(10) Patent No.: US 10,081,030 B2
(45) Date of Patent: Sep. 25, 2018

(54) WATER DELIVERY DEVICE

(71) Applicant: WET, Sun Valley, CA (US)

(72) Inventors: Mark Fuller, Studio City, CA (US); Jim Doyle, Burbank, CA (US); Scott Mahlerbe, Simi Valley, CA (US); John McLaughlin, Temecula, CA (US)

(73) Assignee: WET, Sun Valley, CA (US)

( * ) Notice: Subject to any disclaimer, the term of this patent is extended or adjusted under 35 U.S.C. 154(b) by 0 days.

(21) Appl. No.: 14/211,069

(22) Filed: Mar. 14, 2014

(65) Prior Publication Data

US 2014/0306024 A1 Oct. 16, 2014

Related U.S. Application Data

(60) Provisional application No. 61/800,896, filed on Mar. 15, 2013.

(51) Int. Cl.
*B05B 17/08* (2006.01)
*B05B 1/26* (2006.01)

(52) U.S. Cl.
CPC ..... *B05B 17/08* (2013.01); *B05B 1/265* (2013.01); *B05B 17/085* (2013.01)

(58) Field of Classification Search
CPC ..... B05B 1/12; B05B 1/3033; B05B 1/3073; B05B 17/08; B05B 1/265; B05B 17/085
USPC ..... 239/17, 22, 23, 513, 514, 518, 524, 456
See application file for complete search history.

(56) References Cited

U.S. PATENT DOCUMENTS 1,500,178 A * 7/1924 Bart ..... 239/31
2,988,289 A * 6/1961 Thompson ..... A62C 31/005 239/439
3,150,829 A * 9/1964 Specht ..... A62C 31/02 239/107
3,224,683 A * 12/1965 Morreale ..... C02F 1/645 239/456
4,095,747 A 6/1978 Anderson
4,194,694 A 3/1980 Hickerson
4,248,385 A 2/1981 Hickerson
4,416,420 A 11/1983 Thompson
4,840,313 A 6/1989 Hansen
5,833,145 A 11/1998 Smith
(Continued)

FOREIGN PATENT DOCUMENTS

CN 2095043 U 2/1992
CN 2 868 435 Y 2/2007
(Continued)

OTHER PUBLICATIONS

PCT, International Search Report and Written Opinion, Sep. 5, 2014, 11 pages.
(Continued)

*Primary Examiner* — Christopher Kim
(74) *Attorney, Agent, or Firm* — Maceiko IP

(57) ABSTRACT

A water delivery device is described which includes an outlet pipe through which water is ejected to provide a water display. A disk is positioned relative to the outlet pipe. The relative positions of the disk and outlet pipe are moved so that the disk is located within the outlet pipe or above it to alter the appearance of the water leaving the outlet pipe. As the relative position of the disk and outlet pipe varies, a sequence of water expressions is provided.

17 Claims, 31 Drawing Sheets

(56) References Cited

U.S. PATENT DOCUMENTS

| | | | | |
|---|---|---|---|---|
| 6,131,819 | A * | 10/2000 | Fuller | B05B 17/08 239/20 |
| 6,250,570 | B1 | 6/2001 | Starr et al. | |
| 7,775,457 | B2 | 8/2010 | Schnuckle | |
| 8,225,539 | B2 | 7/2012 | Beebe | |
| 8,245,790 | B2 * | 8/2012 | Lozier | A62C 31/28 169/24 |
| 2007/0267513 | A1 | 11/2007 | Taylor | |
| 2009/0101368 | A1 * | 4/2009 | Lozier | A62C 31/28 169/56 |

FOREIGN PATENT DOCUMENTS

| | | |
|---|---|---|
| CN | 202061763 | 12/2011 |
| JP | S523997 | 1/1977 |
| JP | 2009-042395 | 2/2009 |
| SU | 762994 | 9/1980 |

OTHER PUBLICATIONS

PCT, International Preliminary Report on Patentability, International Application No. PCT/US2014/027472, Sep. 15, 2015, 7 pages.

* cited by examiner

WATER DELIVERY DEVICE

CROSS REFERENCE TO RELATED APPLICATION

The application claims the benefit of U.S. Provisional Application No. 61/800,896, filed Mar. 15, 2013, the contents of which are incorporated herein by reference.

FIELD OF THE INVENTION

The current invention generally relates to water displays, and a water delivery device that may shoot out water in various configurations. For example, the water may be shot out to form an outward expanding water cone. The configuration of the cone may be varied to provide, for example, the appearance of a flower blooming. The water may also form a hollow, vertical tube of water.

BACKGROUND OF THE INVENTION

Various water displays exist that include different types of devices to deliver water. For example, existing water delivery devices may shoot a column of water vertically upward. Other devices may vary the angle at which the column of water is shot.

However, there is a need for innovative water delivery devices that produce dramatic visual effects. For example, there is a need for a water delivery device that may vary the configuration of the water being shot out. There is also a need to precisely control the manner in which the water configuration may be varied.

SUMMARY OF THE INVENTION

In an aspect of the invention, a water delivery device may shoot water into the air in different configurations. For example, the ejected water may form a hollow tube, but may then be varied to resemble a blooming flower. To this end, the device may eject water out of an outlet pipe, which may have a disk in the center. The circumference of the disk may be separated from the inner surface of the pipe by an annular gap. To this end, the circumference of the disk may be slightly smaller than the inner diameter of the pipe, and the edge of the disk may be relatively thin. Depending on the size of the annular gap between the disk and pipe, and the height of the disk edge relative to the top of the outlet pipe, the configuration of the ejected water may vary. For example, the water may resemble an outward expanding water cone where the disk is located at or above the top edge of the pipe. If the disk is drawn down into the pipe, the angle of the cone may be decreased until the cone sides are substantially vertical, thereby forming a hollow, vertical tube of water. With further draw down of the disk, the tube may collapse into a vertical column without a hollow core.

In another aspect of the current invention, the movement between the disk and pipe may be precisely controlled. To this end, the position, velocity and acceleration of the disk movement may be programmatically controlled. The pressure (and hence flow) of the water fed into the device, may also be controlled with precision. The movement of the disk and varying of water pressure may be synchronized. The result of the interaction of these two parameters preferably provides the dynamic formation of water shapes that flutter and fold back on themselves, like the skirt of a dancer or an animated fairy flutter.

Unique aspects of the device include those mechanics that control the precision of operation, as well as feedback control, and the ability to have the moving disk stem penetrate the flow stream without disturbing it. The entire assembly may also be located on a base that withdraws the outlet below the water level between uses, making it disappear to the public.

DETAILED DESCRIPTION OF THE PREFERRED EMBODIMENTS

Figure 1:
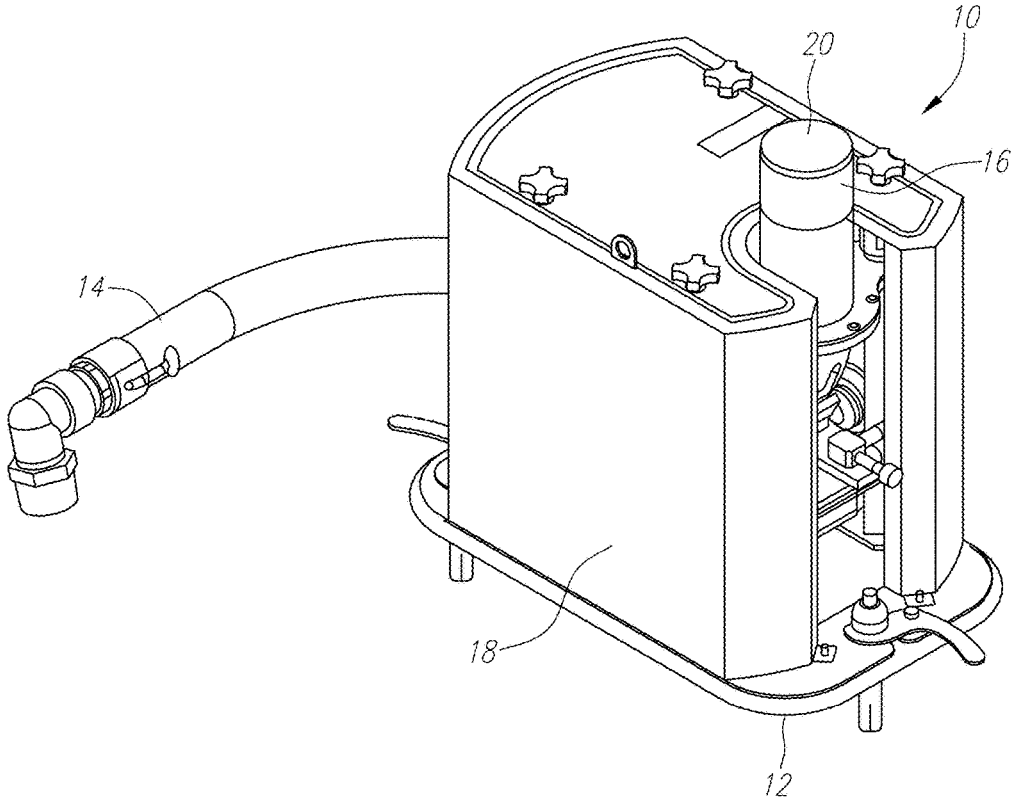
FIG. 1 is a perspective view of a water delivery device.

The water delivery device 10 of the current invention is now described with reference to the figures. Components appearing in more than one figure may bear the same reference numerals. Though the current invention is described with reference to water, fluids or combinations thereof may be used.

As shown in FIG. 1, water delivery device 10 may include base 12, water inlet 14, water outlet or nozzle 16 and cover 18. Disk 20 may be positioned within outlet 16 and may move vertically relative thereto. The vertical movement of disk 20 with respect to outlet 16 may cause the ejected water to form various water configurations thereby providing dramatic visual effects.

Figure 2:
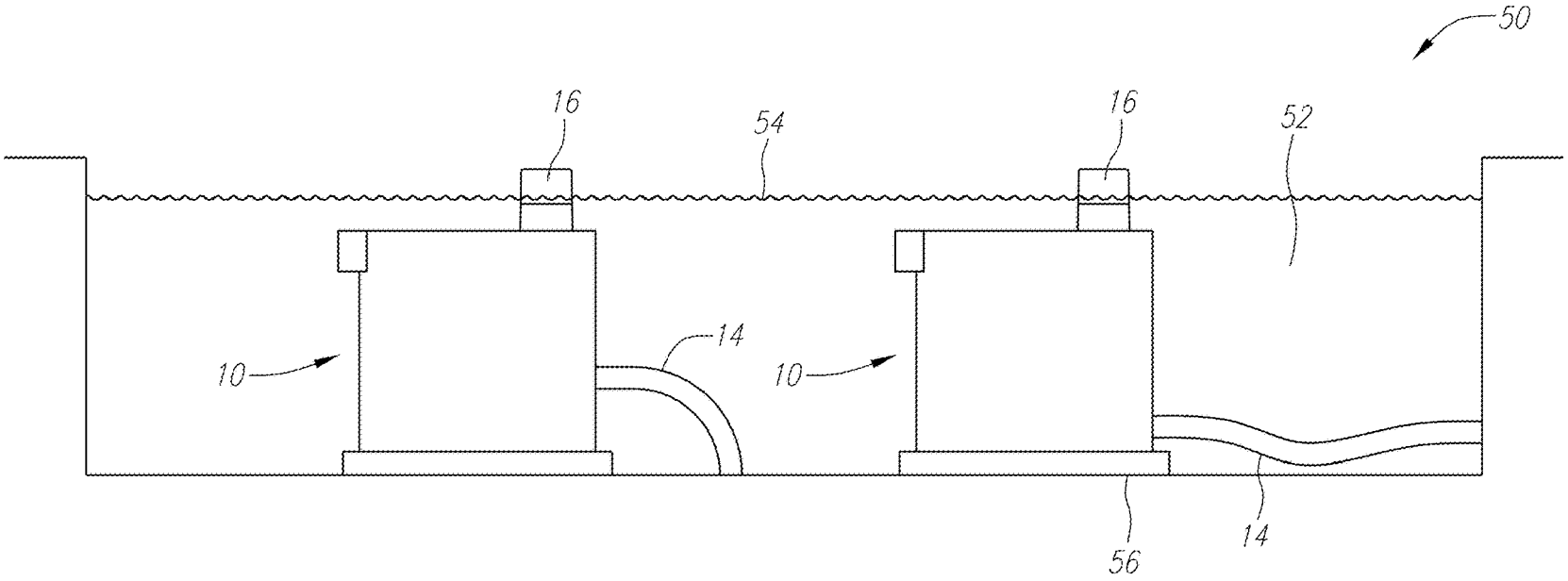
FIG. 2 is a cross-sectional view of a water display and shows water delivery devices situated in a display reservoir.

As shown in FIG. 2, device 10 may be included in water display 50. To this end, display 50 may include water reservoir 52 having a surface 54. Multiple water delivery devices 10 may be located in water display 50. The base 12 of device 10 may be attached to the floor 56 of reservoir 52. Water may be provided to inlet 14 from a supply (not shown).

The top of nozzle 16 may reside under the water surface 54. But as shown by the phantom lines, water outlet 16 may be raised above surface 54 to shoot water according to the current invention.

Figure 3:
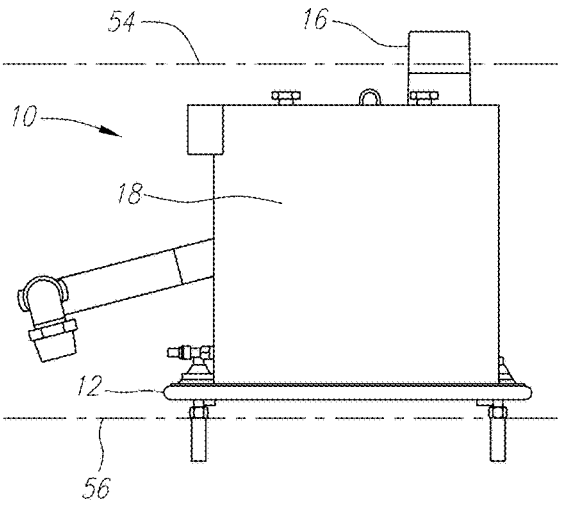
FIG. 3 is a side view of a water delivery device.
Figure 4:
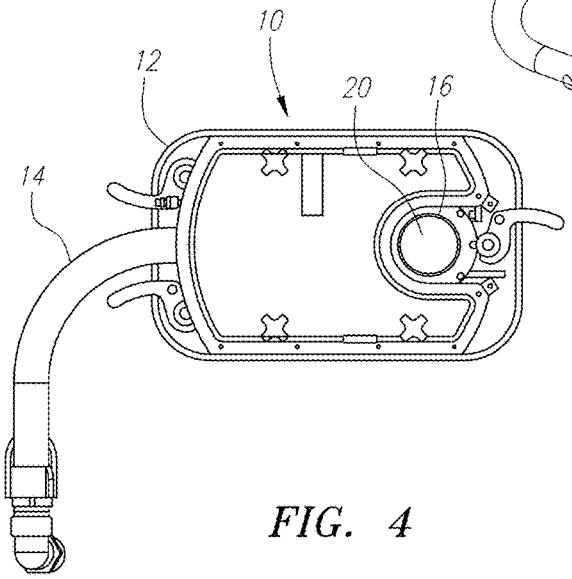
FIG. 4 is a top view of a water delivery device.

FIG. 3 is a side view of water delivery device 10 attached to the reservoir or basin floor 56. As shown, base 12 may attach to floor 56 by bolts or other suitable attachment means. In FIG. 3, outlet 16 is shown as extending above the water surface 54. FIG. 4 is a top view of device showing how disk 20 may be located within the diameter of water outlet 16.

Figure 5:
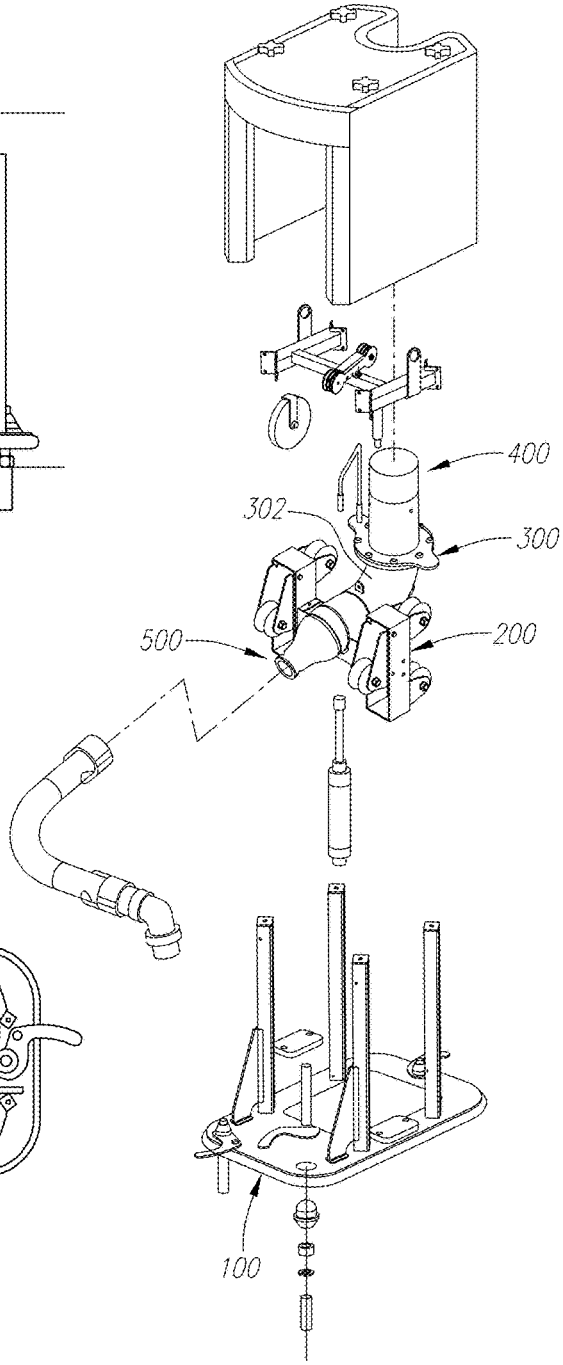
FIG. 5 is an exploded view of a water delivery device.

FIG. 5 is an exploded view of device 10 showing its main assemblies. These may include base frame assembly 100 which may be anchored to the reservoir floor 56. As shown, base frame assembly may include brackets, clamps and other means to hold and support the various cables, water pipes, power lines and other elements of device 10.

Device 10 may also include carriage assembly 200. Carriage 200 may serve to raise and lower the top end of outlet pipe 16 above and beneath the water surface 54. As discussed in more detail later, the vertical movement of carriage assembly 200 may occur due to a cable that extends around a pulley and is also coupled to base frame assembly 100.

Device 10 may also include water pipe assembly 300 which may receive water from a water source of display 50 and direct it to the outlet 16 where water is ejected from device 10. Water pipe assembly may be coupled to carriage assembly 200 so that it may be raised or lowered thereon. As shown in FIG. 5, water pipe assembly 300 may generally comprise a water line or pipe 302 that receives water in a horizontal section, but which bends, e.g., by 90 degrees, so that water is ejected upward.

As mentioned above with reference to FIG. 1, water delivery device 10 may include a cover 18 that may generally cover and provide protection to the water delivery device 10. Cover 18 may attach to the mount plate 102 of the base frame 100 and may generally extend upward and over water delivery device 10. Cover 18 may be attached to the mount plate 102 using bolts, screws, clamps or other attachment means, and it may be preferably that the cover 18 be removable when access to the water delivery device 10 is required. Cover 18 may not extend over bloom nozzle assembly 400 so that it may emit water as described in later sections. Cover 18 is also configured so that it does not interfere with any of the movement of the water delivery device 10 such as the movable carriage assembly 200 or any other assembly within the water delivery device 10.

Nozzle assembly 400 may include disk 20 that may move up and down relative to outlet pipe 16. To this end, either disk 20 or outlet pipe 16 may move relative to the other. As discussed in more detail later, disk 20 may be attached to a rod or other solid or flexible device which preferably positions disk 20 substantially at the center of outlet pipe 16 so that disk 20 and outlet 16 are generally concentric, and so that an annular gap exists there between through which water may exit device 10. In this manner, the flow of water leaving outlet pipe 16 is preferably uniform across its cross section. This, in turn, preferably provides uniformity in the water configuration that is to be observed.

Figure 6:
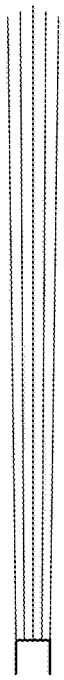
FIG. 6 shows a column of water ejected from a water delivery device.
Figure 7:
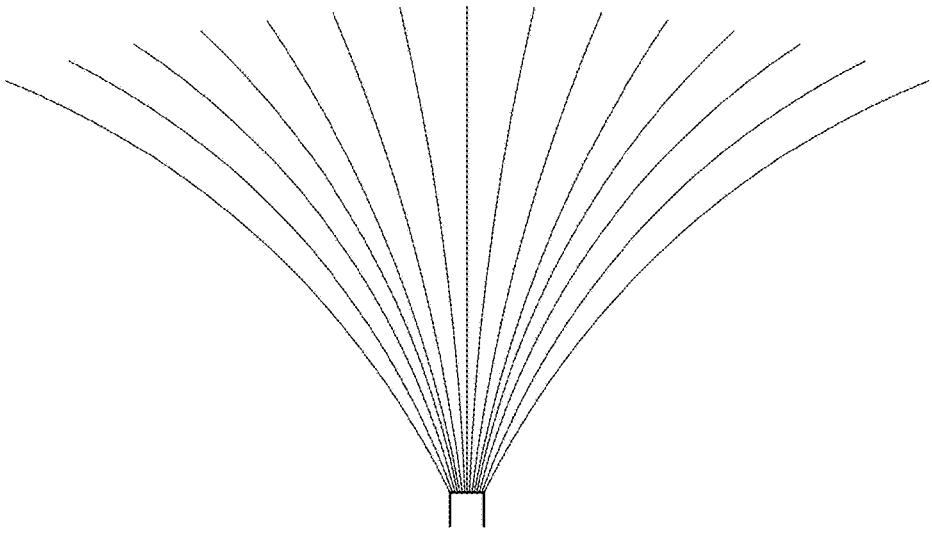
FIG. 7 shows a wider fan pattern of water ejected from a water delivery device.
Figure 8A:
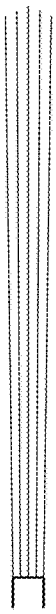
FIGS. 8A-8D show a sequence of configurations of water ejected from a water delivery device.
Figure 8B:
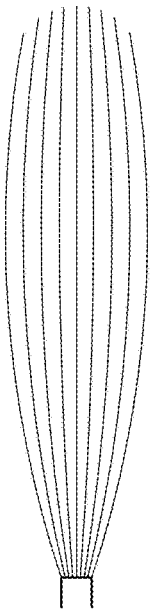
Figure 8C:
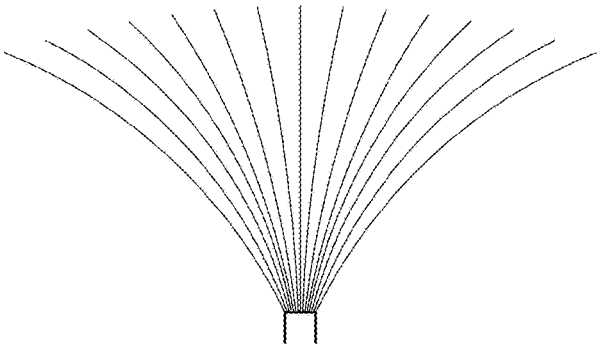
Figure 8D:
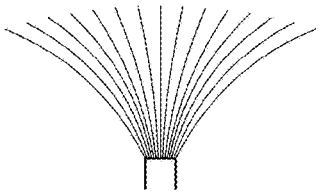
Figure 26:
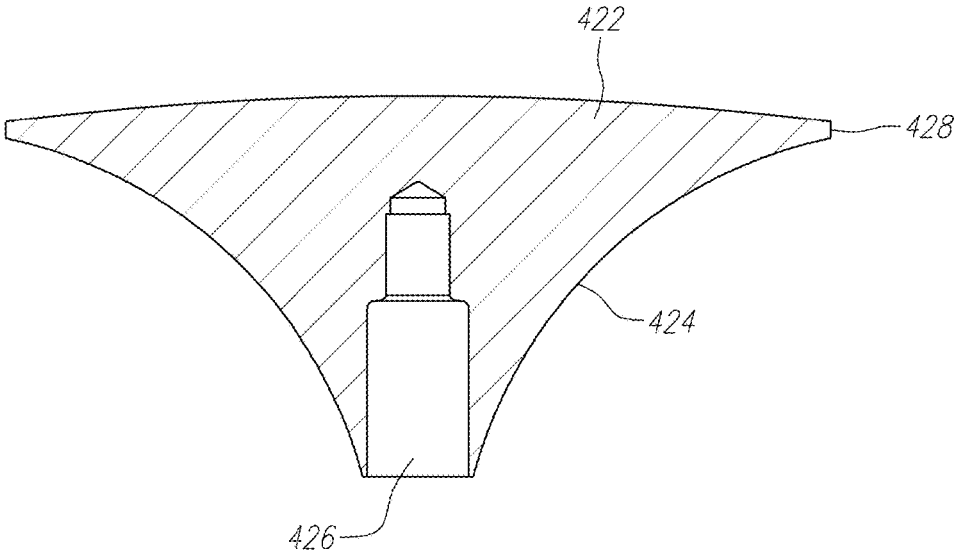
FIG. 26 is a side cross sectional view of a deflector plate.

To this end, FIG. 6 shows how a column of water may be shot out of device 10. FIG. 7 shows how the column may be transformed or "opened" to more of a conical or curved shape. As described in more detail later, the underside of disk 20 may be formed to have concave profile (as shown in FIG. 26) which may direct the water outward when disk 20 is vertically positioned at a desired location relative to the upper edge of outlet pipe 16.

Water delivery device 10 may also include nozzle movement control assembly 500 which vertically positions disk 20 relative to outlet pipe 16. In a preferred embodiment, the rod or other component attached to disk 20 is also coupled to nozzle movement control assembly 500. As discussed in more detail below, for example, the rod or other component attached to disk 20 may engage a cam assembly that effects vertical movement of disk 20. Alternatively, device 10 may include a control mechanism to move outlet pipe 16 relative to disk 20.

Water delivery device 10 may also include various hydraulic lines to effect the vertical movement of disk 20 and/or outlet pipe 16 and serve other functions as described later. Device 10 may also include a control assembly which may provide manual or computer control, sensors that may monitor water flow, a power assembly and other components as described below.

Before discussing the operation and structure of water delivery device 10, the configurations and/or expressions of water it may provide are further described with reference to FIGS. 8A-8D. In general, the configuration of the water shot out of device 10, such as the shape and height of the bloom, may depend on the flow rate of the water out of the upper water pipe 16 (water force psi) and/or the vertical position of the disk or plunger 20 and/or outlet pipe 16 relative to each other. To this end, the interplay of these two factors may produce the desired visual effect.

For example, at a given flow rate, the plunger height can be adjusted to produce a particular bloom, and, at a given plunger height setting, the flow rate can be adjusted to produce a particular bloom. Alternatively, the flow rate and the plunger height can be adjusted in unison to produce a particular bloom.

In this manner, various shapes and water effects, or expression of water, such as shown in FIGS. 8A-8D are possible. These include a solid upward tube or column of water when disc is lowered inside water pipe 16 and below its top edge. A hollow upward tube or column of water may be formed when disc 20 rises up, and an adjustable bloom, or cone having a variable angle, may be formed when disc 20 rises above the upper edge of the upper water pipe 16. Disk 20 may be raised and lowered to open and close the bloom, or adjust the cone angle, accordingly. Other expressions of water that may be provided by device 10 include a disk of water, such as a substantially horizontal disk, and a downwardly directed cone whose angle may be varied. The foregoing expressions of water may be performed in a sequence whereby the expression of water may transition or transform from one expression to another. The sequence may occur both forward and reverse. For example, the expression of water may transition from some or all of the sequence a solid column of water, hollow column of water, cone of water (of varying angle), substantially horizontal disk of water to a downward cone of water, and in the reverse sequence.

Base frame assembly 100 is now further described with reference to FIGS. 9, 10 and 11. As mentioned above, base frame assembly 100 may generally support elements of water display device 10 and may also anchor or otherwise attach device 10 to a surface such as the bottom 56 of water basin 52. To this end, base frame assembly 100 may support movable carriage assembly 200, water piping assembly 300, bloom nozzle assembly 400, the bloom nozzle control assembly 500, as well as other assemblies described in later sections.

Base frame 100 may include a mount plate 102 to which various elements of the base frame assembly 100 may be attached. Mount plate 102 may be constructed of a solid sheet of metal such as steel or aluminum, or other materials such as hard plastic or a composite material that may provide the strength necessary to support the various elements of the water display device 10.

The mount plate 102 may rest on and be attached to a base tube 104 that may generally run around the periphery of the mount plate 102. It is preferred that the base tube 104 run around the entire outer circumference of the mount plate 102 to provide lateral support to the mount plate 102 and to act as a footing for the base frame assembly 100 to rest on other surfaces. Base tube 104 may be hollow or may solid and may be constructed out of metal such as steel or aluminum, or other materials such as hard plastic or composite materials.

Base frame assembly 100 may also include upward pointing guide rails 106 that may be mounted to the top surface of the mount plate 102. As described in further detail in later sections, these guide rails 106 may guide the movable carriage assembly 200 as it travels upward and downward. Guide rails 106 may be welded to the top surface of the mount plate 102, or attached thereto using other means such as bolts or clamps. Guide rails 106 may also include gussets 108 that may provide additional lateral support to the guide rails 106. Gussets 108 may be welded directly to the guide rails 106 and the top surface of the mount plate 102 or may be attached using other means such as bolts or clamps. As shown in FIG. 9, base frame assembly 100 may include four guide rails 106, but other numbers of guide rails 106 may also be used.

Figure 9:
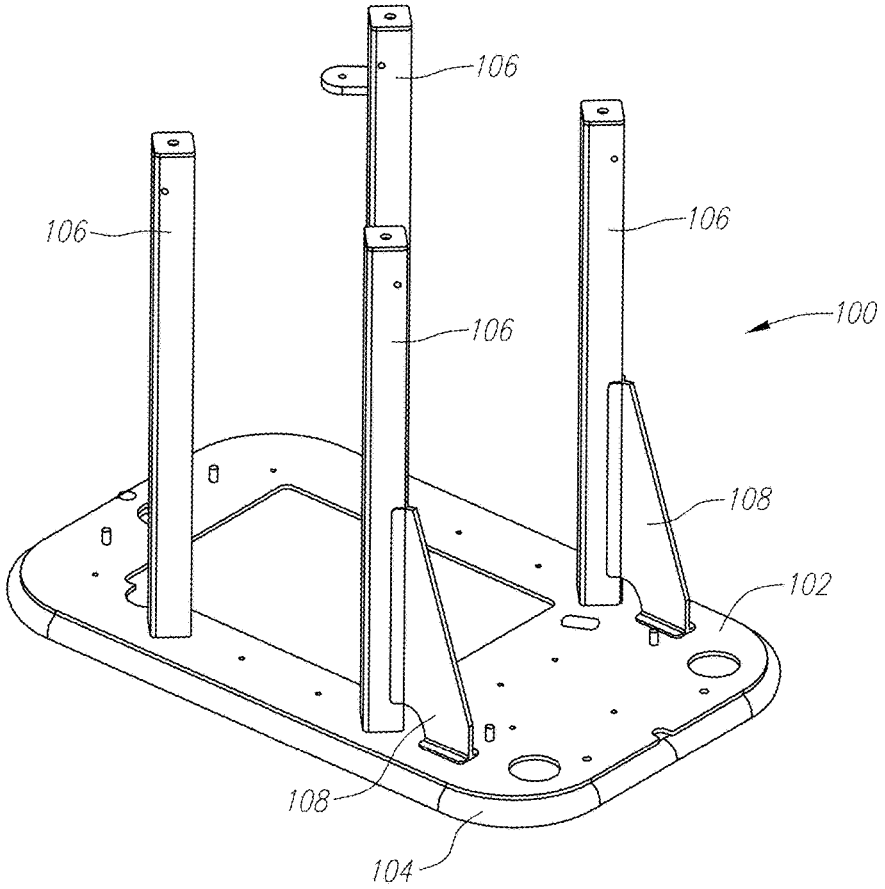
FIG. 9 shows base frame assembly of a water delivery device.

As shown in FIG. 9, guide rails 106 may have generally square cross sections, or may also have other shaped cross sections such as rectangular, circular, oval shaped or other shapes. As discussed later, it is preferred that the cross section of the guide rails 106 comprise a shape that will allow a roller 220 of the drive roller assembly 206 (not shown) to generally fit onto and align on a vertical edge of the guide rail 106 as the drive roller assembly 206 travels up and down the guide rail 106. For example, the guide rails 106, with their generally square-shaped cross sections as shown in FIG. 9, may engage a roller 220 (of FIG. 18) which may have a V-shaped notch 230 along its circumference. The notch 230 may engage a square side corner of the guide rail 106 and continue to stay aligned to the square corner of the guide rail 106 as the roller 220 travels up and down along the vertical length of the rail 106. In addition, the guide rails 106 may have grooves, ridges, creases or other edge elements along their vertical lengths that may allow a drive roller to fit onto and stay aligned to the vertical lengths of the guide rail 106. This is described in further detail in later sections.

In addition, the guide rails 106 may be solid or hollow, and may be constructed of metal such as steel or aluminum, or other materials such as hard plastic or a composite material that may provide the strength necessary to support and guide the movable carriage assembly 200 as discussed in later sections.

Figure 10:
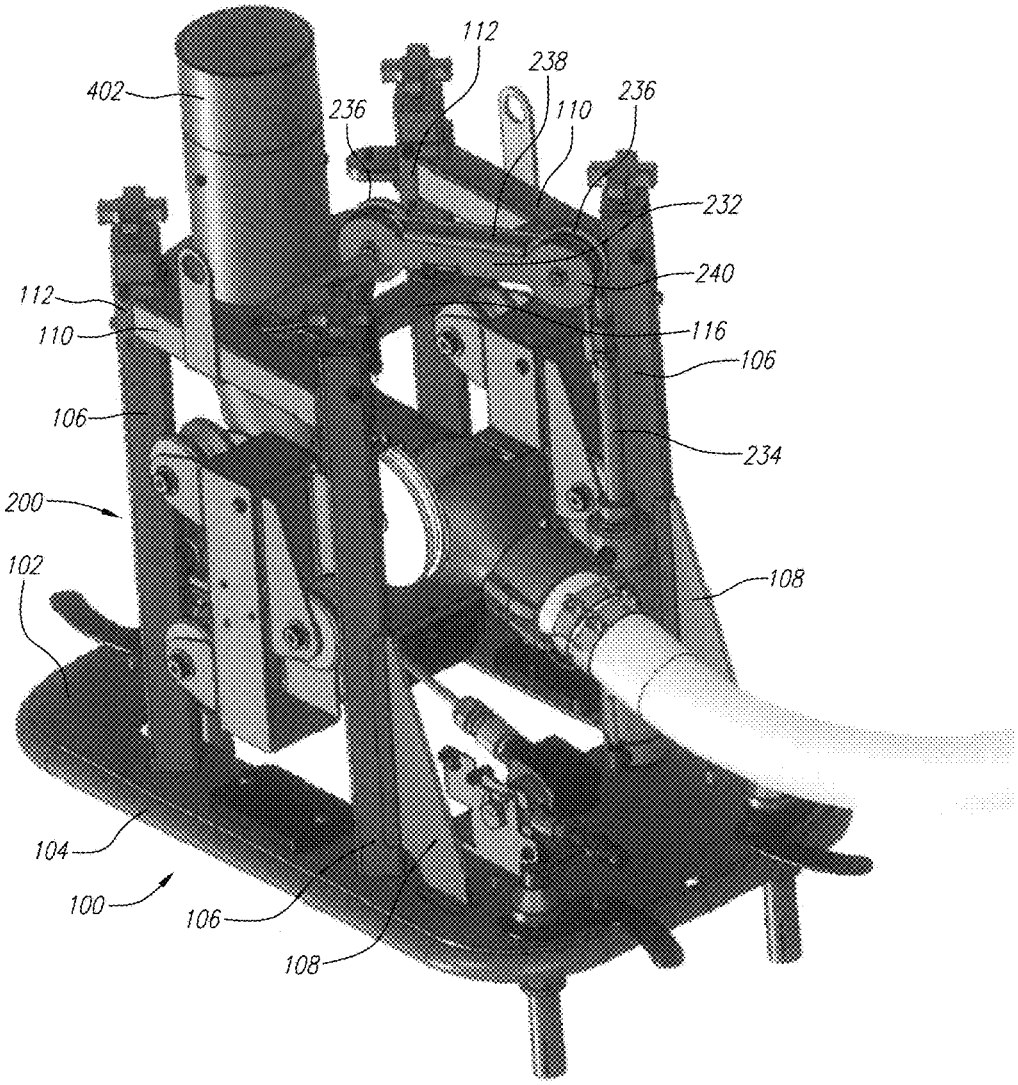
FIG. 10 is a perspective view of a water delivery device without a cover.
Figure 11:
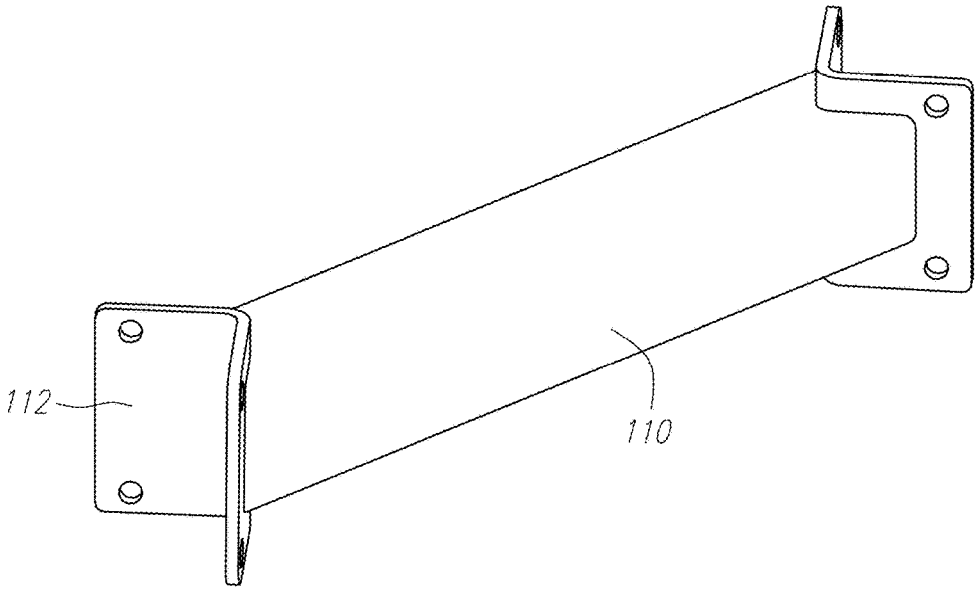
FIG. 11 shows a perspective view of a cross member.

As shown in FIG. 10, upward pointing guide rails 106 may also include cross-members 110 that may be attached between two or more guide rails 106 to provide additional support to the guide rails 106. In addition, the ends of the cross-members 110 may include bolt plates 112 that may allow the cross-members 110 to be securely attached to the sides of the guide rails 106 by means of bolts, clamps, or other means of attachment such as welding. FIG. 11 depicts these bolt plates 112 as V-shaped to generally mate with the generally square corners of the guide rails 106 as depicted in FIGS. 9 and 10. However, depending on the shape of the cross section of the guide rails 106, these bolt plates 112 may be other shapes to properly mate with the guide rails 106 accordingly.

Figure 20:
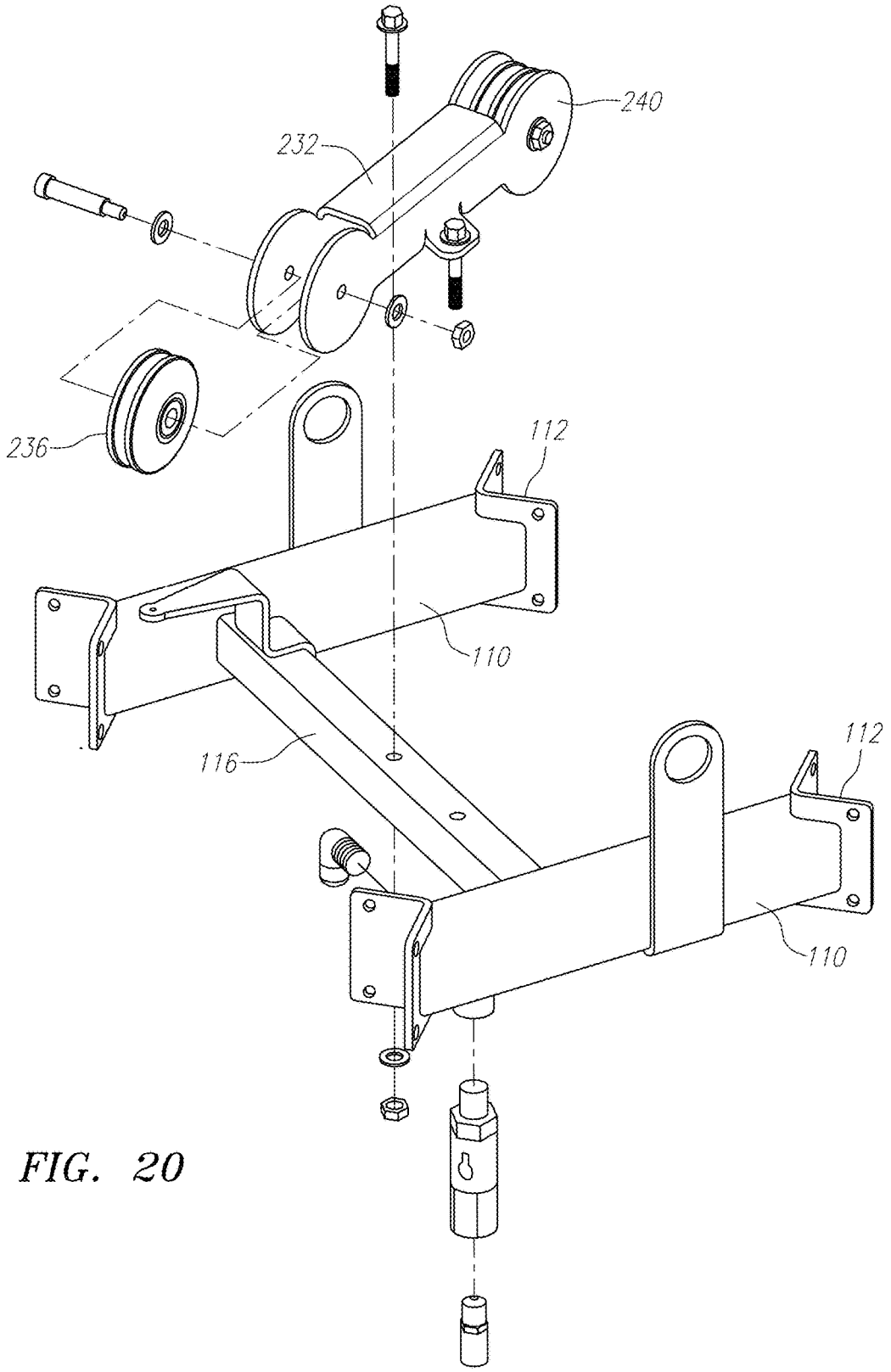
FIG. 20 is an exploded view of a cross member hard stop.

In addition, base frame assembly 100 may also include a cross-member hard stop 116 that may attach between two generally parallel cross-members 110 as shown in FIG. 20. The ends of cross-member hard stop 116 may be welded to each cross-member 110 or may be attached using bolts, screws or other attachment means. In addition to providing additional support to the guide rails 106 and the cross-members 110, the cross-member hard stop 116 may also prevent the movable carriage assembly 200 from traveling vertically beyond a particular desired position. The cross-member hard stop 116 may also be configured to support the pulley assembly 232. These applications of the cross-member hard stop 116 will be described in detail in later sections.

As mentioned above, the guide rails 106 may guide the movable carriage assembly 200 that may move up and down vertically within the base frame assembly 100. Movable carriage assembly 200 will now be described in further detail with respect to FIGS. 10-21.

The movable carriage assembly 200 may raise the top edge of the output nozzle body 16 of FIG. 10 so that it is close to or above the surface of the water, so that water display device 10 may shoot water. Carriage assembly 200 may also lower the top edge of outlet pipe 16 to a position below the surface of the water. In this manner, device 10 may not be visible to the observer.

Figure 12B:
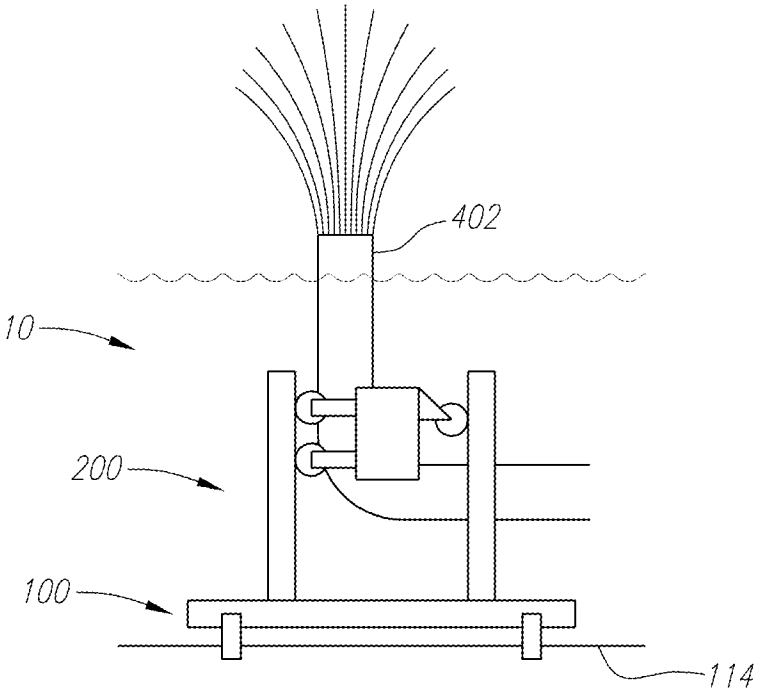
FIG. 12B is a cross-sectional view of a water delivery device partially above water.
Figure 12A:
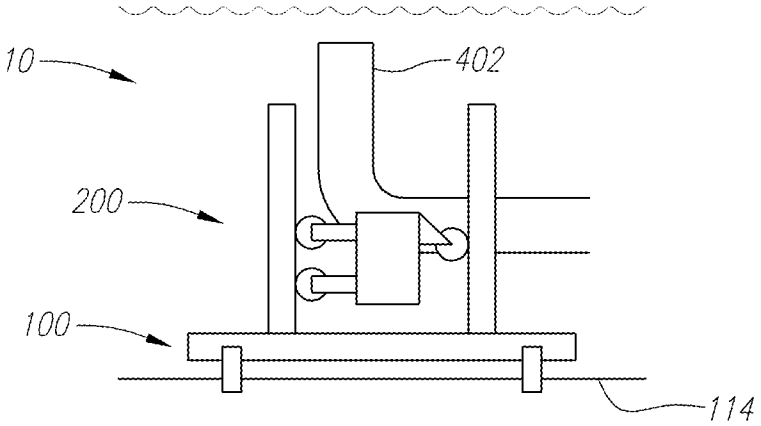
FIG. 12A is a cross-sectional view of a water delivery device submerged.

The foregoing description is generally depicted in FIGS. 12A and 12B. FIG. 12A shows the base frame assembly 100 attached to the bottom floor 114 of the water basin with the movable carriage assembly 200 in a lower position. This may position the upper nozzle body 402 below the surface of the water and out of view. FIG. 12B shows the moveable carriage assembly 200 in an upper position. This positions the upper nozzle body 402 above the surface of the water. In this above-water position, the water display device 10 may shoot water to provide the visual effects described herein.

Figure 13:
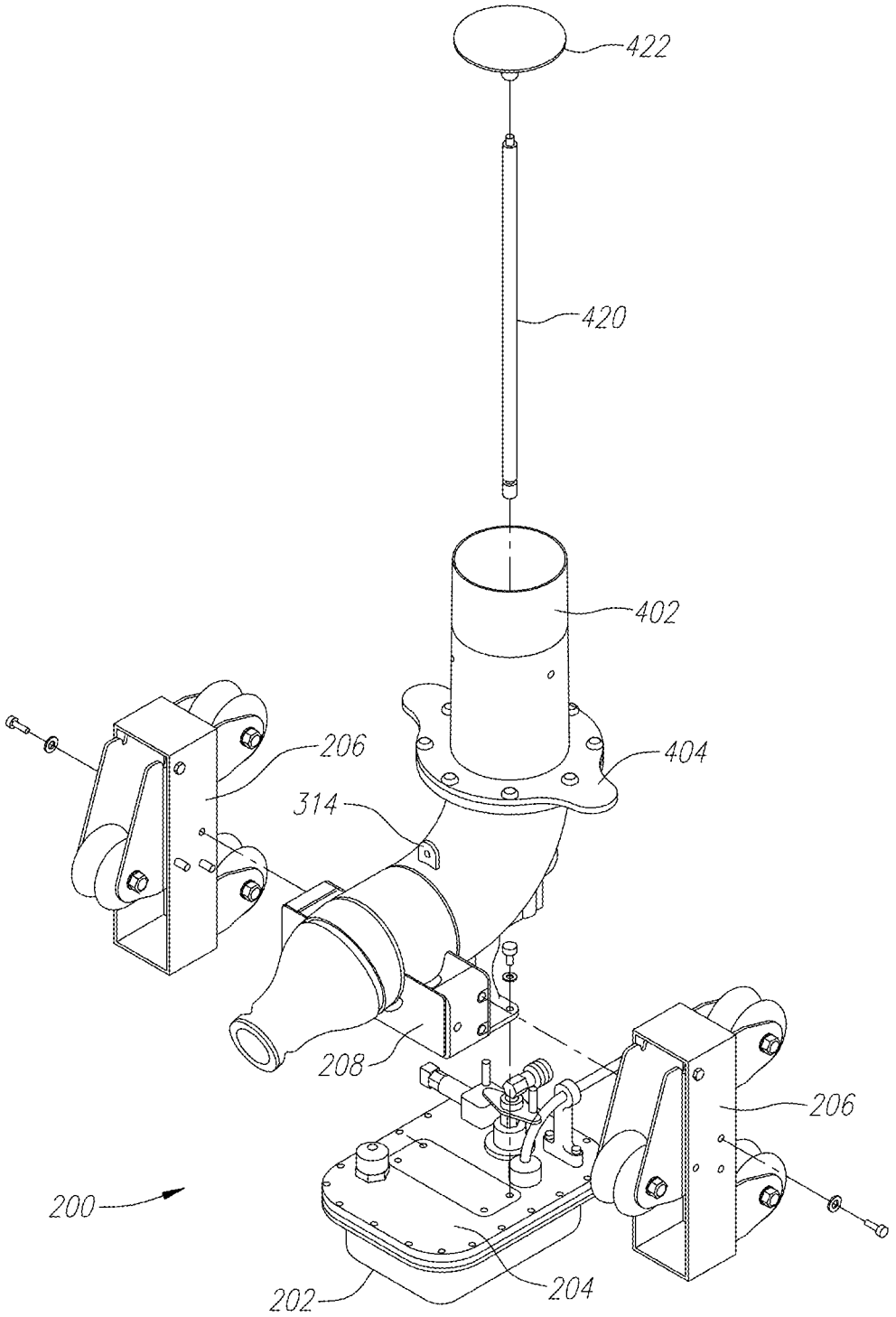
FIG. 13 is an exploded view of a water delivery device.

As shown in FIG. 13, the movable carriage assembly 200 may include an electronics enclosure 202, an electronics enclosure top plate 204, drive roller assemblies 206, a piping assembly mount plate and wheel drive bracket 208 as well as other components and assemblies.

The electronics enclosure 202 may include the various electronic components and devices necessary to power and control the various assemblies and other components of the water display device 10. These components and functionalities are described in further detail in later sections.

The electronics enclosure 202 may include an enclosure top plate 204 that may support other elements including the piping assembly base foot 308 positioned below the elbow 310 in the piping assembly 300 as described in later sections.

Figure 14:
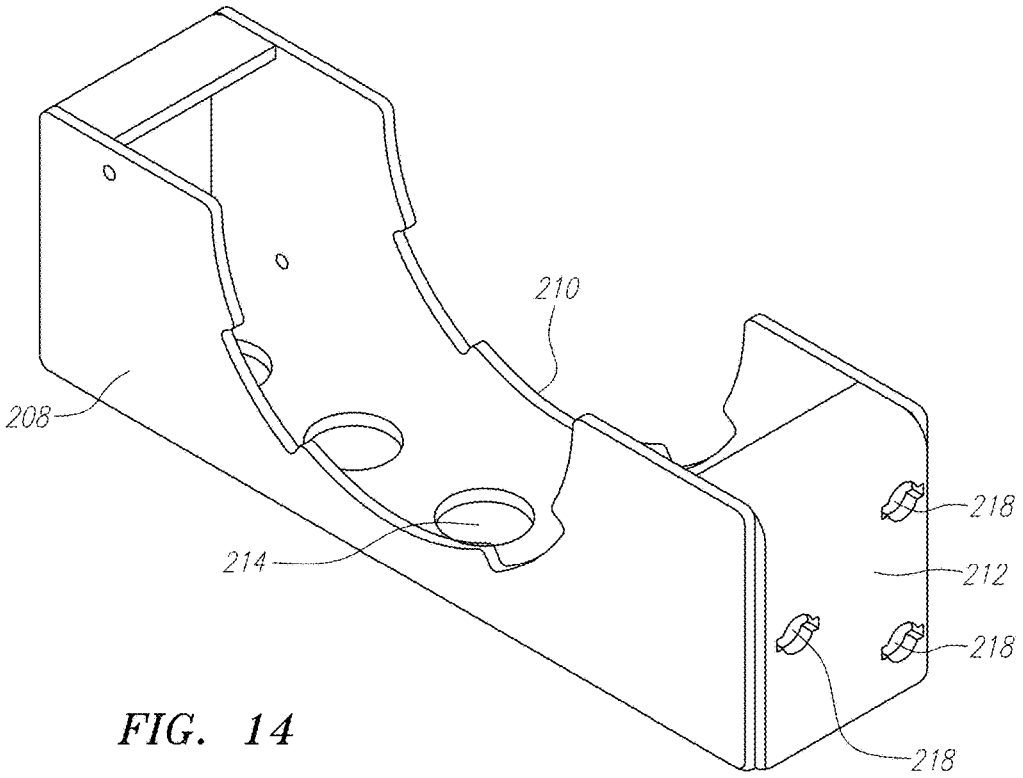
FIG. 14 is a perspective view of a mount plate and wheel drive bracket.

As shown in FIG. 14, the piping assembly mount plate 208 may comprise a generally rectangular bracket that may also include a cutout area 210 that may correspond to the curvature of the proximate section of the water piping assembly 300. The mount plate and wheel drive bracket 208 may be attached to a section of the piping assembly 300 by bolts, screws, clamps brackets, welding methods or other attachment means that provide the necessary strength to adequately support the water piping assembly 300 and any other components and assemblies that may be attached to it.

Figure 15:
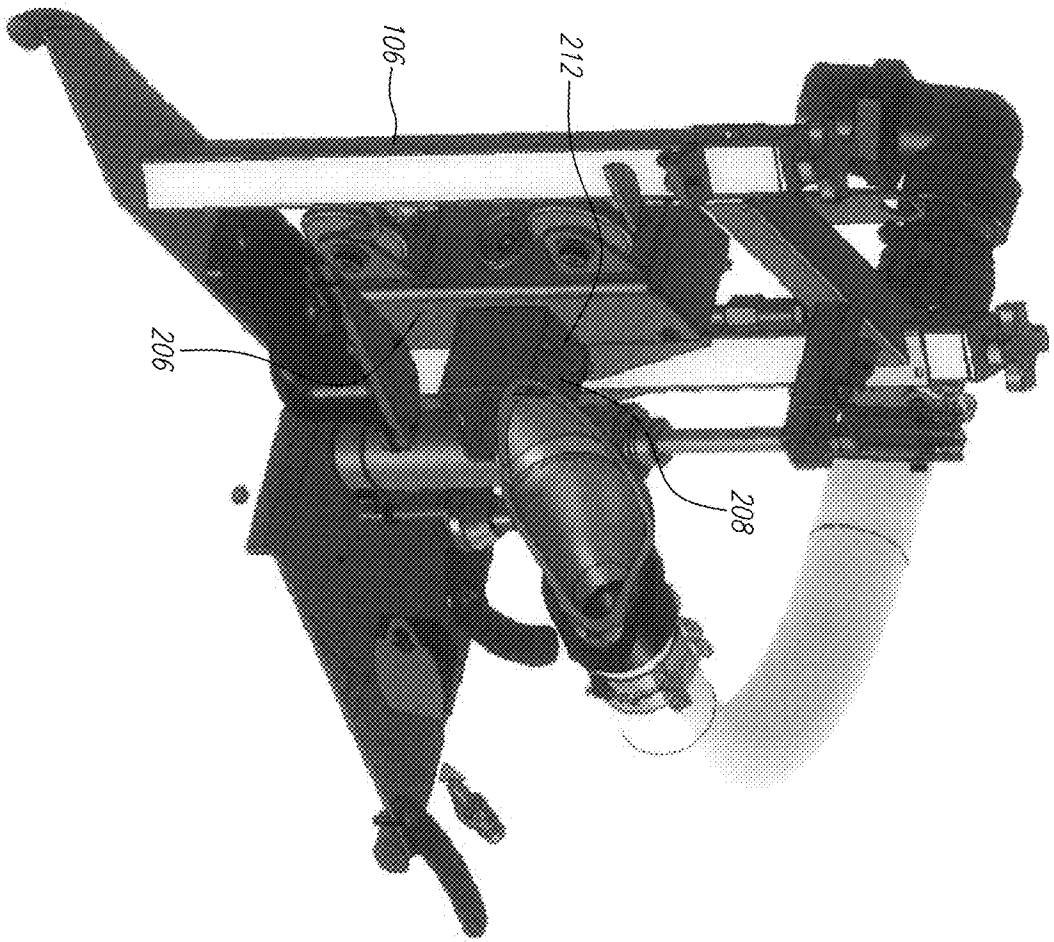
FIG. 15 is a cut-away view of a water delivery device.

The mount plate 208 may also include end sections 212 that may be configured to attach to and support the drive roller assemblies 206. For instance, the end sections 212 may include holes 218 as shown in FIG. 14 that allow the drive roller assemblies 206 to be bolted or screwed to the end sections 212. Accordingly, the drive roller assemblies 206 may have holes 216 that generally align with the holes 218 of the bracket 208 such that the roller assemblies 206 may be bolted, screwed or otherwise attached to the bracket 208. FIG. 15 depicts an end section 212 of the piping assembly mount plate and wheel drive bracket 208 attached to the drive roller assembly 206 as described above.

Figure 16:
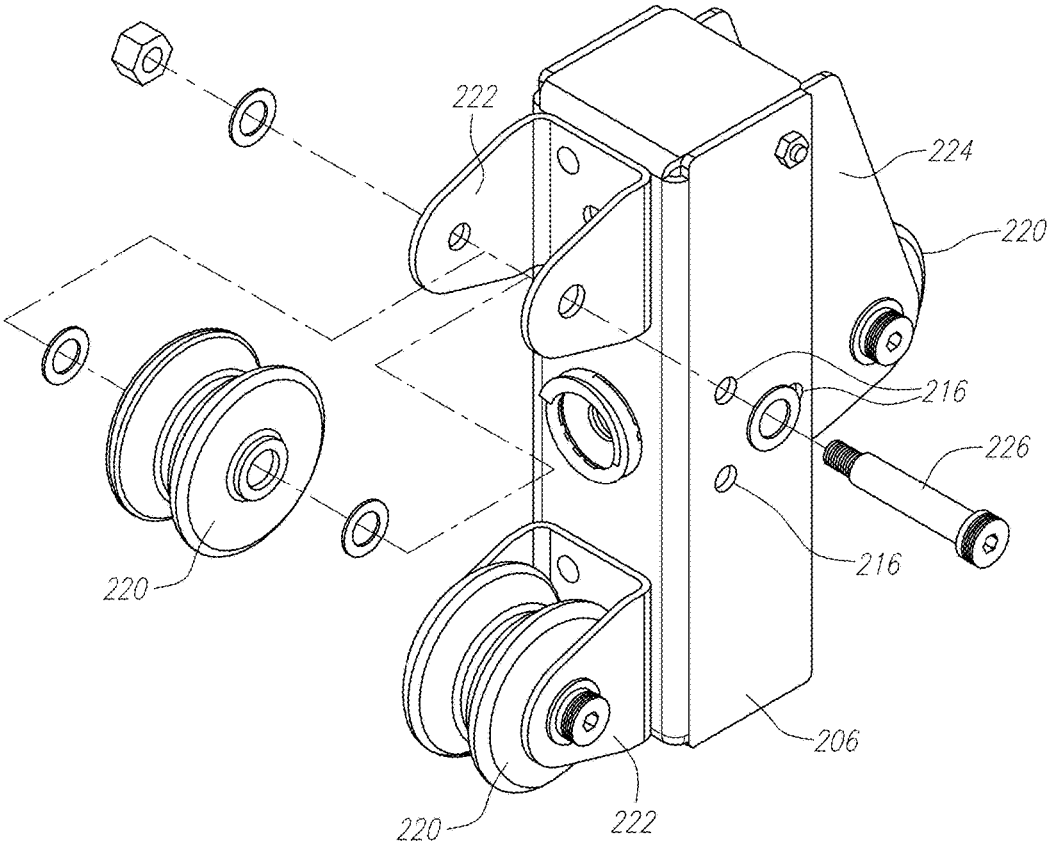
FIG. 16 is a perspective view of a drive roller assembly.

The drive roller assemblies 206 are now described in further detail. One purpose of the drive roller assemblies 206 is to engage the guide rails 106 of the base frame assembly 100 so that the movable carriage assembly 200 may ride up and down along the guide rails 106. The drive roller assemblies 206 may consist of a generally rectangular bracket as shown in FIG. 16 with roller holders 222, 224 attached to it. Rollers 220 may be held within the roller holders 222, 224 using roller bolts 226 running through the axis of the rollers 220 allowing them to turn radially within the roller holders 222. Roller holders 222 may be fixedly attached to the drive roller assembly 206 using bolts or screws or other attachment means such as welding methods as shown in FIGS. 16, 17A and 17B.

Figure 17A:
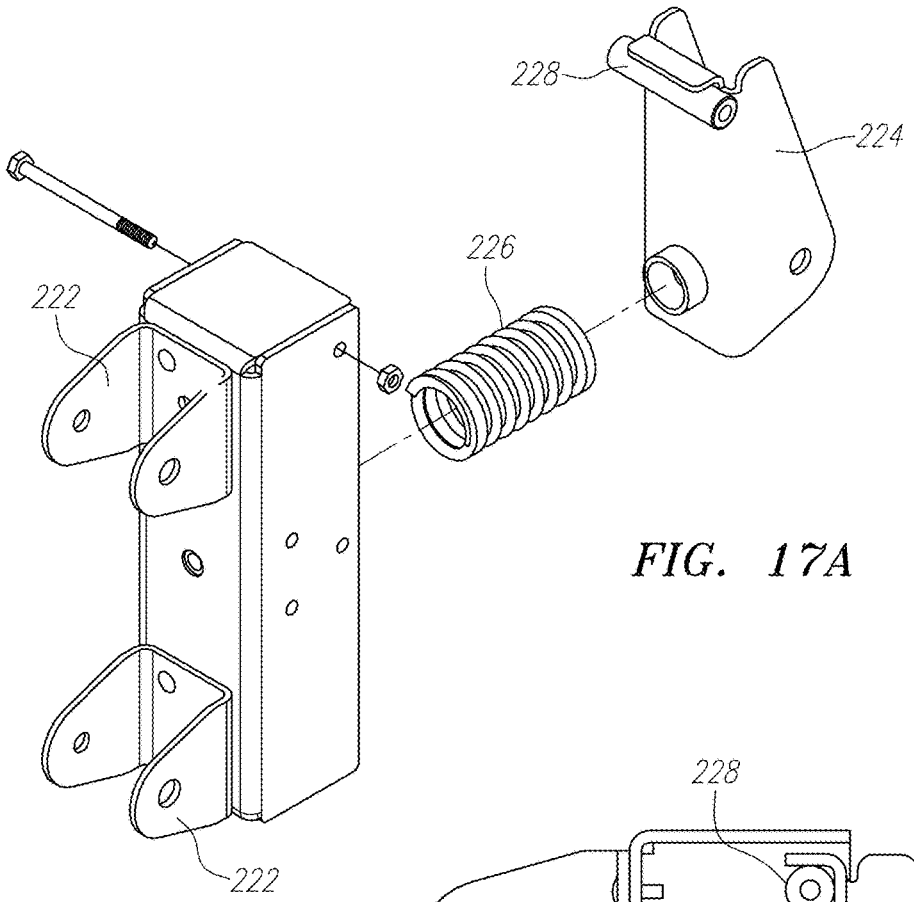
FIG. 17A is an exploded view of a drive roller assembly.
Figure 17B:
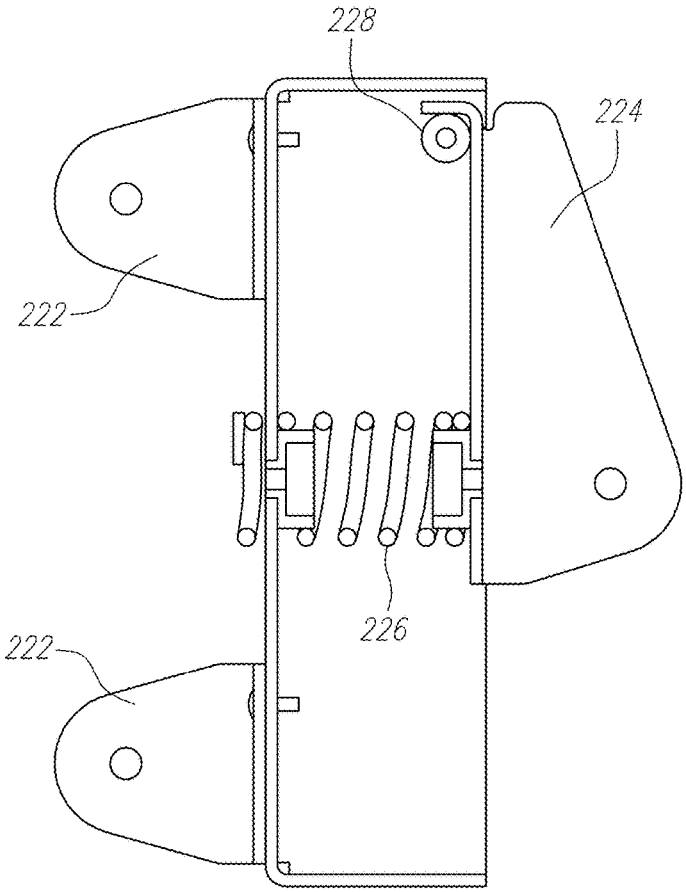
FIG. 17B is a side view of a drive roller assembly.

It is preferred that roller holders 224 be attached to the drive roller assembly using a hinge 228, as shown in FIGS. 17A and 17B, such that the roller holder 224 may pivot about hinge 228 which may allow the position of the roller holder 224 to be adjustable. By allowing the position of the roller holder 224 to be adjustable, the position of the roller 220 that may be attached to the roller holder 224 may also be adjusted.

Furthermore, it is preferred that the roller holder 224 be attached to an inner spring 226 that may be held within the drive roller assembly 206 and that the torque load on the inner spring 226 be preloaded such that the roller holder 224 may be generally pushed outward by the inner spring 226 and held in an outward position when connected to the hinge 228.

Figure 19:
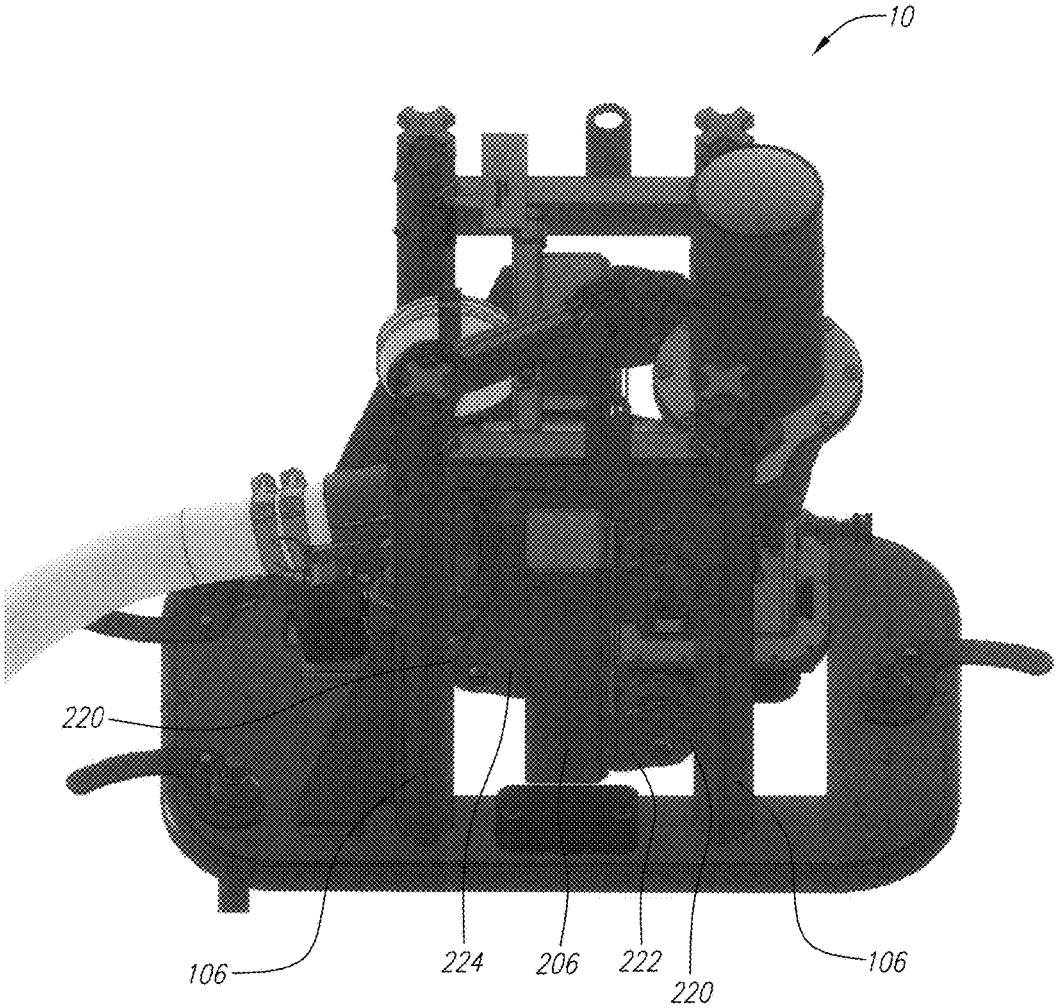
FIG. 19 is a perspective view of a water delivery device.

It is also preferred that the inner spring 226 not be fully compressed such that the roller holder 224 may be pressed inward into the drive roller assembly 206 to further compress the inner spring 226. As shown in FIG. 19 and described in further detail in later sections, this configuration may allow the drive roller assemblies 206 to be placed between two guide rails 106 and be held snugly in place by the outward force of the inner spring 226.

Figure 18:
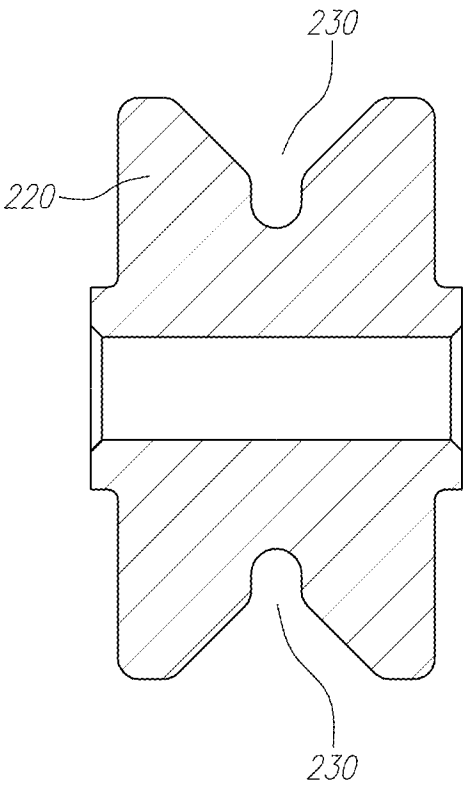
FIG. 18 is a cross sectional view of a drive roller.
Figure 18:
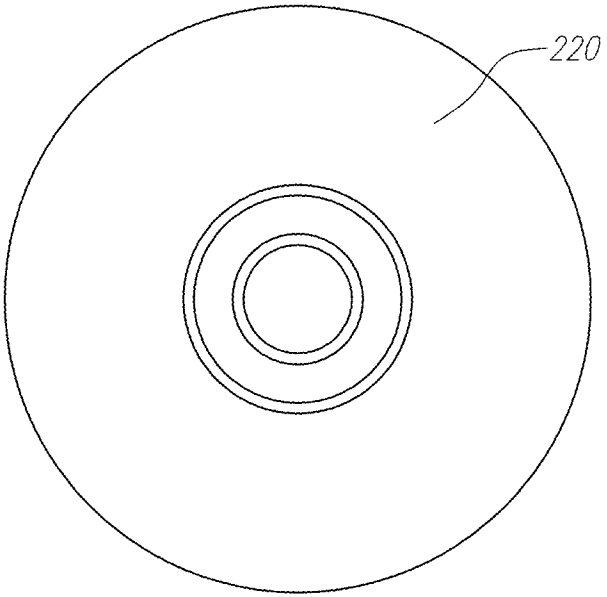

As shown in FIG. 18, the rollers 220 may resemble small wheels and may also have a V-shaped groove 230 about their circumference. As described in the above section with reference to the guide rails 106 in FIGS. 9 and 10, this V-shaped groove 230 may engage the square corners of the guide rails 106 as the rollers 220 travel up and down the length of the guide rails 106. This alignment of the V-shaped groove 230 on the rollers 220 with the generally square corners of the guide rails 106 is depicted in FIGS. 10 and 19.

As depicted in FIG. 13, the movable carriage assembly 200 may have two drive roller assemblies 206, with one drive roller assembly 206 attached to each end of the mount plate and wheel drive bracket 208. With the electronics enclosure top plate 204 attached to the electronics enclosure 202, and the piping assembly base foot 308 attached to the top of the electronics enclosure top plate 204, and with a drive roller assembly 206 attached to each end of the wheel drive bracket 208, the movable carriage assembly 200 may be formed. An expanded view of this is shown in FIG. 13.

As described in earlier sections, the movable carriage assembly 200 may travel up and down along the guide rails 106, and its position may be controlled by pulley assembly 232 and pulley actuator 234. As depicted in FIG. 20, pulley assembly 232 may comprise of a pulley bracket 240 configured to hold two pulley wheels and bearings 236, one on each end of the pulley bracket 240, and a pulley cable 238 (shown in FIG. 10). While FIG. 20 depicts the use of two pulley wheels and bearings 236, other numbers of pulley wheels and bearing 236 may be used.

Figure 21:
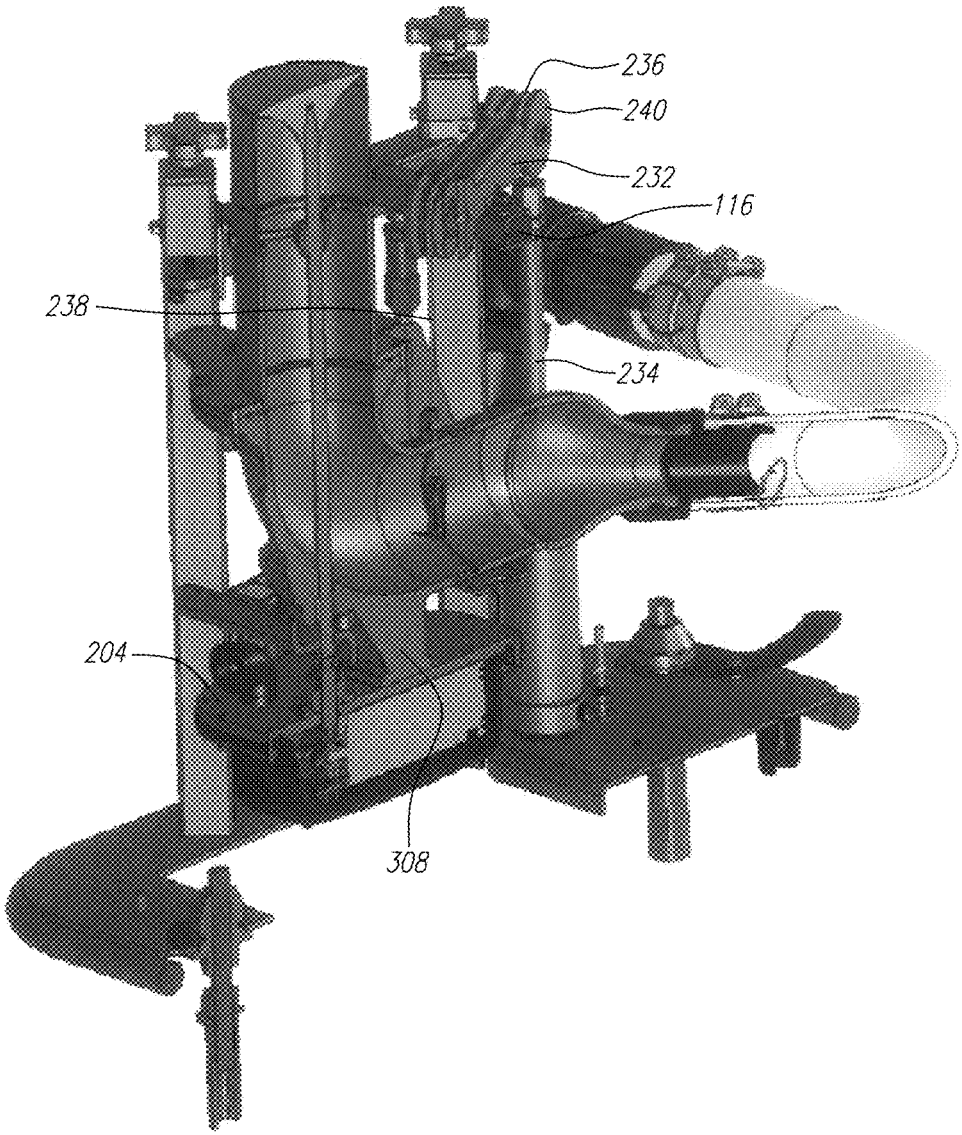
FIG. 21 is a side cut-away view of a water delivery device.

As shown in FIG. 10 and FIG. 21, the pulley assembly 232 may be supported by and attached to the cross-member hard stop 116 by means of bolts, screws, welding methods or other attachment means. The position and orientation of the pulley assembly 232 may be chosen such that the pulley cable 238 may easily extend from the pulley actuator 234, where one end of the pulley cable 238 may be attached, over the pulley wheels and bearings 236, and down to a position on the movable carriage 200 where another end of the pulley cable 238 may be attached.

It should be noted that the pulley actuator 234 may be fixed to the base plate 102 of the base frame assembly 100 using bolts, screws, brackets, clamps or other means. In this configuration, the pulley actuator 234 may compress and pull downward on the pulley cable 238. The pulley cable 238 may extend up from the pulley actuator 234, over the pulley wheels and bearings 236, and down to a position on the movable carriage assembly 200 where it may be attached. In this manner, it may exert an upward pulling force on the movable carriage assembly 200 as the pulley cable 238 rides on pulley wheels and bearings 236. This upward pulling force on the movable carriage assembly 200 may cause the carriage 200 to travel upward and be guided by the guide rails 106 as described above. Similarly, the pulley actuator 234 may extend and release pressure on pulley cable 238 which may allow carriage assembly 200 to lower in position. Once in the proper position, pulley actuator 234 may lock tight and hold the pulley cable 238 from moving. Other locking mechanisms within device 10 may also be used to lock the position of movable carriage assembly 200 which may act to hold the carriage 200 in position during operation of delivery device 10. Gravity pulling downward on the movable carriage assembly 200 as it hangs from pulley cable 238 as well as the upward force of water being emitted from top nozzle 402 which may also tend to push movable carriage down may also act to hold the movable carriage assembly 200 in position.

Figure 22:
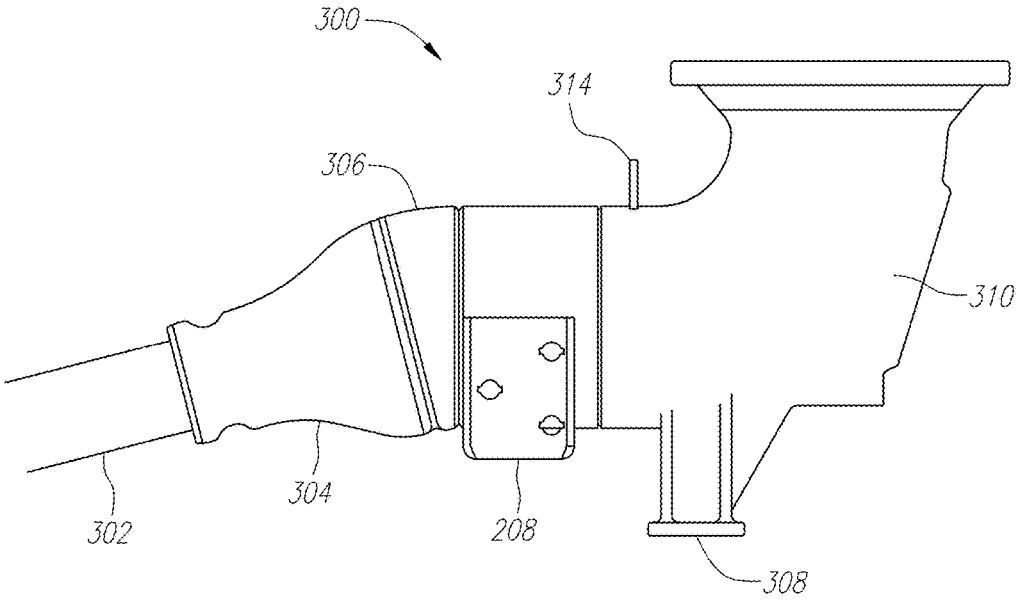
FIG. 22 is a side view of a water piping assembly.
Figure 23:
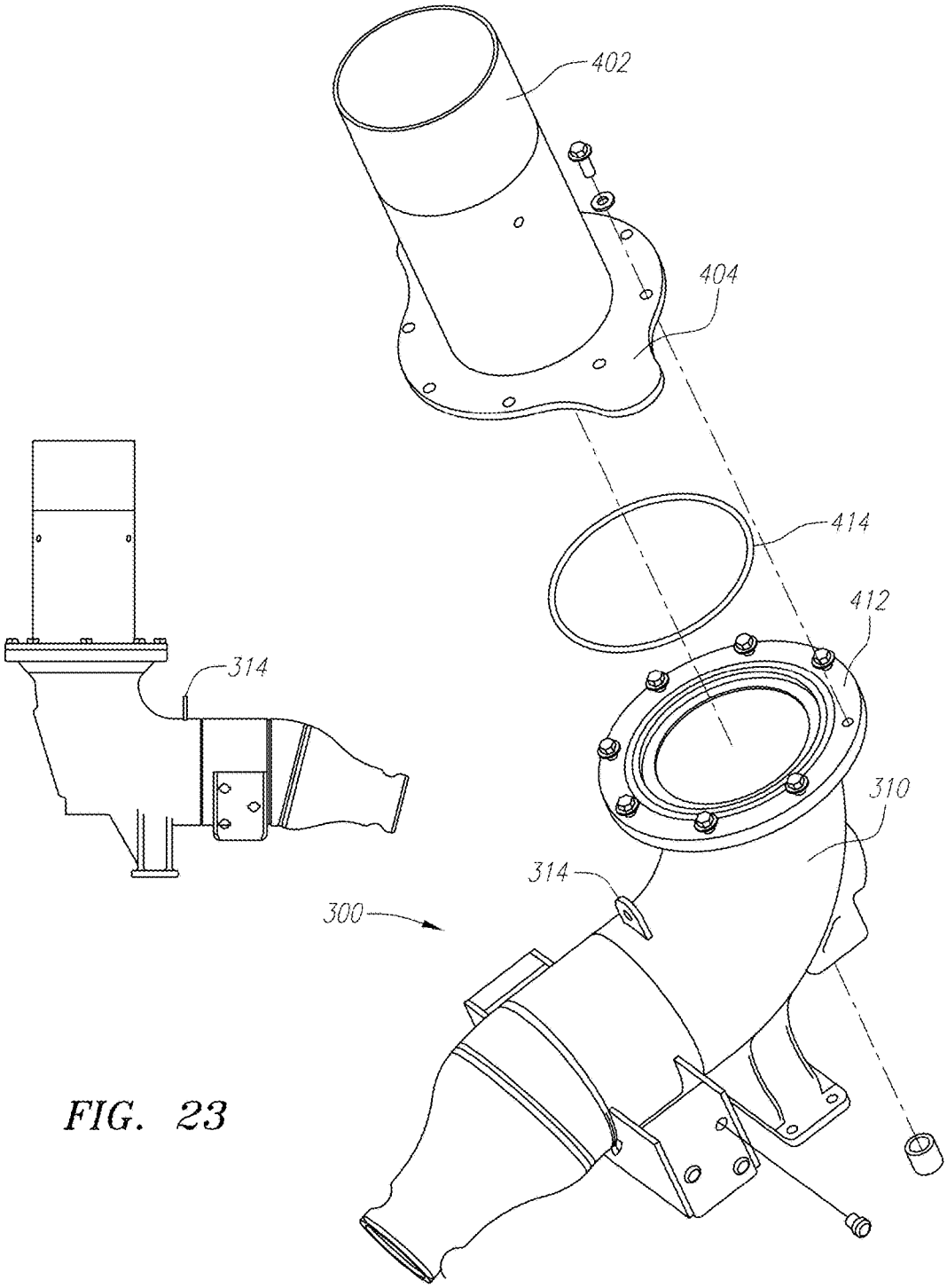
FIG. 23 is an exploded view of a water piping assembly and upper nozzle body.

As shown in FIG. 21, the pulley cable 238 may be connected directly to a section of pipe of the water piping assembly 300. FIGS. 22 and 23 depict the main elbow 310 having an eye lift 314 that may be attached to the top of the main elbow 310. Eye lift 314 may be attached to the top of the main elbow 310 by bolts, screws, clamps or other attachment means, or may pass through the top wall of the main elbow 310 and be attached within the main elbow 310 by use of similar attachment means as depicted in FIG. 21. It is preferred that any attachment means within the main elbow 310 not overly agitate the water flowing through the piping assembly 300. Accordingly, pulley cable 238 may be attached directly to the eye lift 314 and may thereby be attached to the water piping assembly 300.

In addition, pulley cable 238 may also be attached to other sections of the water piping assembly 300 or to other components of the movable carriage assembly 200 that may provide adequate support. The pulley actuator 234 shown in FIG. 21 may be controlled by a computer or other controller (not shown) that may compress or release the pulley actuator 234 in order to move the carriage assembly 200 to its desired position along the guide rails 106. It should be noted that the pulley actuator 234 may be driven by an electric motor, hydraulic fluid pressure, pneumatic pressure, or by other means.

The water piping assembly 300 is now described in reference to FIGS. 21, 22, 23 and 23A. The water to be shot out of the water display device 10 may enter the water display device 10 through the water input pipe 302. As shown in FIG. 22, water flowing into the input pipe 302 may encounter a water flow reducer 304. The water flow reducer 304 may include a pipe expansion transition section that may consist of an outwardly tapered pipe section that may uniformly increase the inner diameter of the water pipe over the transition length of the reducer 304. This water flow reducer 304 may act to slow the flow of water according to the Venturi effect. The purpose of this will be described in later sections.

After passing through the water flow reducer 304, the water may encounter a modified elbow 306 as shown in FIG. 22. FIG. 22 shows a modified elbow 306 having an approximate angle of 15 degrees, but other angles may be implemented. The modified elbow section 306 may serve to mate the water flow reducer 304 with the main elbow 310.

After passing through the modified elbow 306, the flowing water may encounter the main elbow 310. FIG. 22 depicts the main elbow 310 as generally being a 90 degree elbow, but other angles may be used. The main elbow 310 may effectively transition and redirect the water from traveling in a generally horizontal direction to a generally vertical direction in anticipation of the water being shot out of outlet pipe 16. The main elbow 310 may attach to the upper nozzle body 402 and nozzle flange 404 as shown in FIG. 23.

Figure 23A:
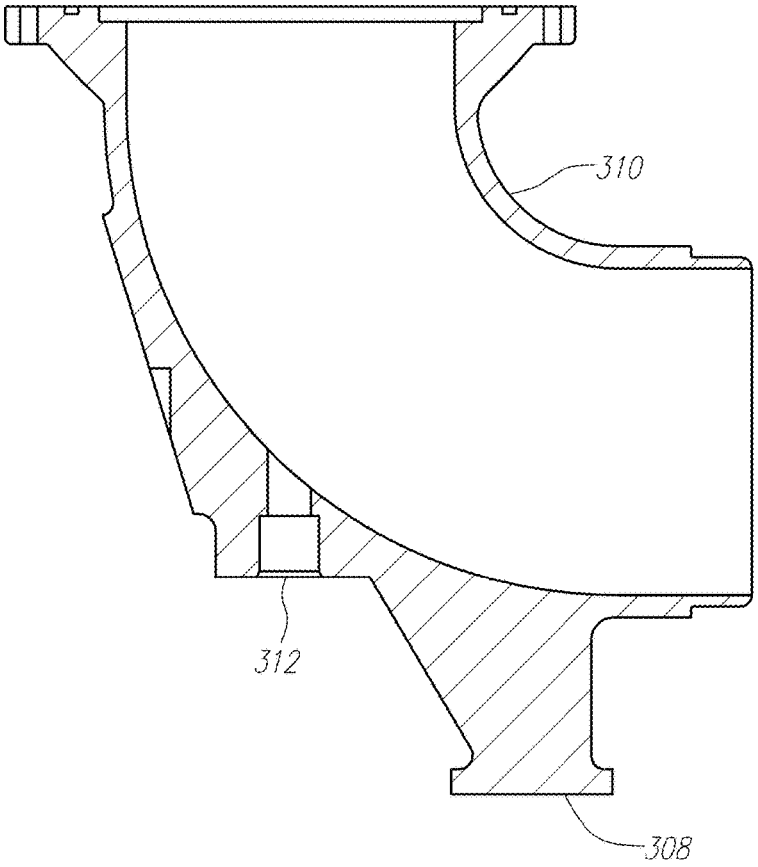
FIG. 23A is a side cross sectional view of a main elbow.

As shown in FIG. 23A, the main elbow 310 may include a lower nozzle shaft exit hole 312 that may allow the nozzle shaft 420 (not shown) that may run vertically within the upper nozzle body 402 (not shown) to pass through the bottom section of the main elbow 310 such that it may engage with the bloom nozzle movement control assembly 500 (not shown). This will be described in detail in later sections, but in general, hole 312 accommodates the shaft that raises and lowers disk 20 relative to the outlet pipe 16. Alternatively, outlet pipe 16 may be moved relative to disk 20.

It is preferred that the transition points between the input pipe 302, the flow reducer 304, the modified elbow 306, the main elbow 310 and the upper nozzle body 402 be water tight.

As water travels through the turn of the main elbow 310, the water pressure across the pipe's cross section may become non-uniform due to turbulence caused by the relatively sharp bend. However, by slowing the velocity of the water flow prior to the elbow 310, the flow reducer 304 may reduce agitation caused by the bend of the main elbow 310. Alternatively, flow straighteners may be employed in a section of pipe downstream from the main elbow 310. Flow straighteners may comprise of honeycomb plates, baffles or guides within the pipe cross section that may generally smooth out turbulent and transitional water flows.

As discussed in earlier sections with reference to FIGS. 13 and 14, the water piping assembly 300 may be attached to the movable carriage assembly 200 by means of the piping assembly mount plate and wheel drive bracket 208. As shown in FIG. 14, the mount plate 208 may have a generally semi-circular cutout area 210 that may generally correspond in shape to the cross section of the water piping assembly 300 at a position between the modified elbow 306 and the main elbow 310, or at another position of the water piping assembly 300 that may provide adequate support to attach the water piping assembly 300 to the movable carriage assembly 200.

Accordingly, the water piping assembly 300 may fit into and be fixedly attached to the cutout area 210 of the water piping mount plate 208 as shown in FIG. 13 (expanded view) and FIG. 15 (cutout view). The water piping assembly 300 may be attached to the water piping mount plate 208 by using bolts, screws, clamps, welding methods or other means. Because water piping assembly 300 is fixed to the movable carriage assembly 200, the water piping assembly 300 may be raised and lowered in unison with the movable carriage assembly 200.

The bloom nozzle assembly 400 is now described in detail with reference to FIGS. 13, 23, 24, 25A, 25B and 26. The bloom nozzle assembly 400 may affect the manner in which water leaves device 10 because it affects the vertical position of disk 20. The bloom nozzle assembly 400 may also manipulate the shape and bloom of the output water to obtain the desired visual effect or expression of water. This will be described in more detail in later sections. The bloom nozzle assembly 400 may include an upper nozzle body 402, a nozzle flange 404, an inner spider support 406, a nozzle shaft 420 and a deflector plate 422.

As shown in FIG. 23, the upper nozzle body 402 may comprise a circular pipe though other shapes such as an oval, triangle or other shapes depending on the desired water display effect or expression of water. The upper nozzle body may be attached to the upper output rim of the main elbow 310 by means of a nozzle flange 404. The output rim of the main elbow 310 may include an output flange 412 that may be bolted, welded or otherwise attached to the bottom of the nozzle flange 404. An O-ring 414 may be positioned between the output flange 412 and the nozzle flange 404 to help insure that the junction is water tight. The bottom of the upper nozzle body 402 may be attached to the top of the nozzle flange 404 by means bolts, screws, clamps, welding methods or other means. The bottom of the upper nozzle body 402 and the top of the nozzle flange 404 may both be complementarily threaded such that the upper nozzle body 402 may screw tight into the top of the nozzle flange.

Figure 24:
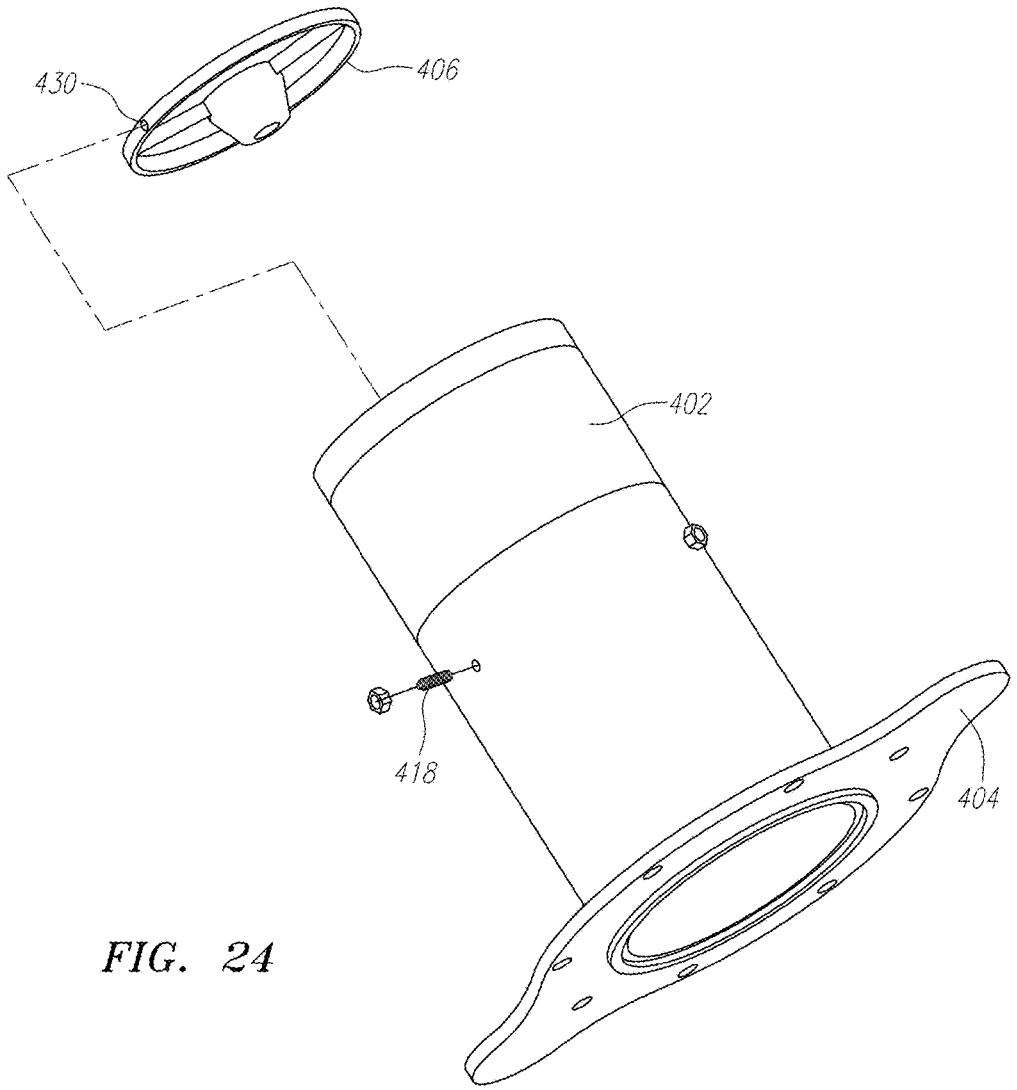
FIG. 24 is an exploded view of an upper nozzle body and spider support.

An inner spider support 406 may be inserted into and attached within the inner cross section of the upper nozzle body 402 as shown in FIG. 24 (exploded view). The inner spider support 406 may comprise a circular outer ring 408, a circular inner ring 412, and at least one radial spoke 410 that may connect the inner ring 412 to the outer ring 408. While FIG. 25 depicts three radial spokes 410 connecting the inner ring 412 to the outer ring 408, other numbers of radial spokes 410 may be used.

Figure 25A:
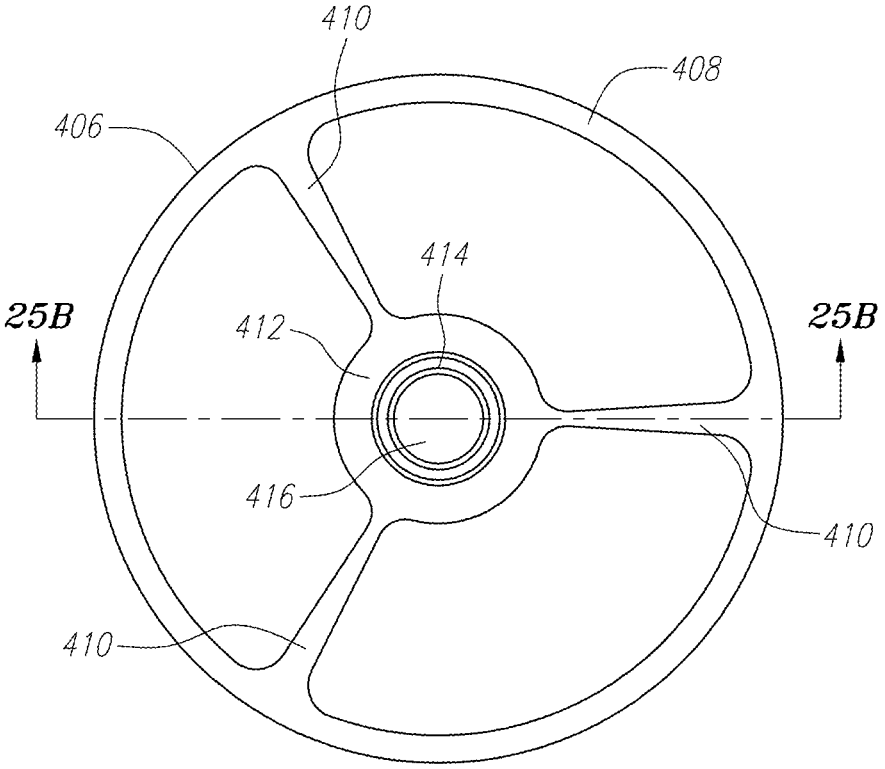
FIG. 25A is a top view of a spider support.

As shown in FIG. 25A, it is preferred that the inner ring 412 is concentrically located in the center of the outer ring 408, and that the outer diameter of the outer ring 408 be similar to the inner diameter of the upper nozzle body 402 into which it may be inserted and attached. This way, the inner spider support 406 may slide into the upper nozzle body 402 and fit snugly within the cross section of the upper nozzle body 402.

The inner spider support 406 may be secured in position within the cross section of the upper nozzle body 402 using lock nuts and set screws 418 that pass through holes in the side of the upper nozzle body 402 and into threaded holes 430 in the sides of the outer ring 408 of the inner spider support 406. This is depicted in FIG. 24 (exploded view). It is preferred that the position of the inner spider support 406 be parallel to the cross section of the upper nozzle body 402 such that it is generally perpendicular to the inner pipe walls of the nozzle body 402. In addition, it is preferred that the center hole 416 of the inner ring 412 of the inner spider support 406 be located in the center of the cross section of the upper nozzle body 402.

As shown in FIG. 25A, the center ring 412 of the inner spider support 406 may also include a center bearing 414 that may make contact with and generally support the nozzle shaft 420 (not shown).

Figure 25B:
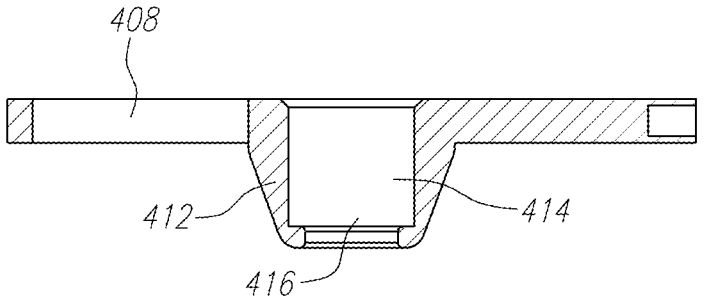
FIG. 25B is a side cross sectional view of a spider support.

As shown in FIG. 25A, the radial spokes 410 may be tapered such that they may be thinner at the junction to the inner ring 412 compared to the junction to the outer ring 408. In addition, the center ring 412 may have a conical shape as depicted in FIG. 25B, with the smaller diameter of the conical shape generally located beneath the outer ring 408. The tapered spokes 410 and the conical shaped inner ring 412 may allow the inner spider support 406 to be located within the cross section of the water flow running upward through the upper nozzle body 402 without overly agitating or otherwise disrupting the uniform water flow through the upper nozzle body 402.

As shown in FIG. 13, the bloom nozzle assembly 400 may also include a nozzle shaft 420 that generally runs upward through the center of the upper nozzle body 402. The nozzle shaft 420 may have a generally circular cross section and may be constructed out of metal such as steel or aluminum, out of hard plastic or out of other rigid or non-rigid materials. As such, the nozzle shaft 420 may be solid or hollow or may be a combination of solid and hollow in different sections along its length. In addition, the nozzle shaft 420 may be constructed out of flexible materials such as a plastic strand, a threaded or solid string or rope, a chain, or other flexible assemblies. Being flexible in design may allow the nozzle rod to be fabricated more easily and less expensively than a solid or hollow stiff rod.

Nozzle shaft 420 may pass through the inner hole 416 of the inner spider support 406 and be supported by the inner bearing 414 in the upper nozzle body 402. The diameter of the inner hole 416 within the bearing 414 may be chosen to allow the nozzle shaft 420 to pass through the inner hole 416 and be generally supported such that any lateral movement by the nozzle shaft may be minimized or eliminated while still allowing the nozzle shaft 420 to move vertically up and down. This way, the spider support 406 may keep the nozzle shaft 420 concentrically located within the upper nozzle body 402 and protect it from buckling. Furthermore, by concentrically supporting the nozzle shaft 420, the spider support 406 may allow for more precise vertical linear movement of the nozzle shaft 420, and may help prevent the nozzle shaft 420 from jerking under high water pressure. The movement and control of the nozzle shaft 420 will be described in detail in later sections.

The nozzle shaft 420 may also pass through the lower nozzle shaft exit hole 312 in the main elbow 310 such that it may engage with the bloom nozzle movement control assembly 500 (not shown).

With the center hole 416 of the inner spider support 406 positioned to be in the center of the cross section of the upper nozzle body 402, it is preferred that the lower nozzle shaft exit hole 312 in the main elbow 310 be positioned such that when the top section of the nozzle shaft 420 is held in the center hole 416 of the spider support 406 and the bottom section of the nozzle shaft 420 is held in the lower nozzle shaft exit hole 312 that the nozzle shaft 420 runs vertically up through the center of the cross section of the upper nozzle body 402 and generally perpendicular to the cross section of the upper nozzle body 402.

It is also preferred that while the nozzle shaft 420 runs through the lower nozzle shaft exit hole 312 that the junction between the nozzle shaft 420 and the lower nozzle shaft exit hole 312 allows the nozzle shaft to move up and down vertically, that it minimizes or eliminates any lateral movement of the nozzle shaft 420 and that the junction is water tight.

As shown in FIG. 13, the bloom nozzle assembly 400 may also include an upper deflector plate 422 (on disk 20 when referenced earlier) attached generally to the top of the nozzle shaft 420. The top of the deflector plate 422 may be generally circular in shape or may be other shapes to that correspond to the general shape of the nozzle body 402 such as oval shaped, triangular or other shapes. It is preferred that the deflector plate 422 have a diameter that is slightly less than the diameter of the upper rim of the upper nozzle body 402 so as to provide an annular gap there between.

The bottom of the deflector plate 422 may have a hole 426 that may allow the deflector plate 422 to be attached to the top end of the nozzle shaft 420. That is, the top end of the nozzle shaft 420 may be inserted into and attached within the bottom hole 426 on the deflector plate 422. The top end of the nozzle shaft 420 may be pressure fit and locked within the hole 426 or the top end of the nozzle shaft 420 and the hole 426 may be complimentarily threaded such that the top end of the nozzle shaft 420 may be screwed into the hole 426 on the bottom of the deflector plate 422. The top of the nozzle shaft 420 may be attached to the bottom of the deflector plate 422 by other means such as welding methods, bolts, screws, clamps or other means.

As shown in FIG. 26, the bottom 424 of the deflector plate 422 may be inwardly tapered from its upper rim 428 to where it may generally attach to the top of the top of the nozzle shaft 420. This tapered shape may deflect and act to guide water passing upward through the nozzle body 402 past the deflector plate 422 and may influence the expression of water, such as the shape and effect of the resulting water display bloom. This will be discussed in more detail in later sections. The tapered shape of the bottom 424 may be conical, parabolic or some other transitional form. In addition, the bottom transitional section 424 of the deflector plate 422 may also have ridges, notches, gaps, holes or other textures that may also influence the shape and appearance of the output water display as it deflects the output water.

It should be noted that if the nozzle shaft 420 is comprised of a flexible material, it may be preferable that the upward water flow through the upper nozzle body 402 be somewhat uniform across the cross section of the nozzle body 402 such that the forces applied by the upward flowing water onto the bottom tapered lower section 424 of the deflector plate 422 be somewhat uniform and generally concentrically constant around the lower surface area of the deflector plate 422. By being somewhat uniform, these forces may help to hold the deflector plate 422 in a concentrically centered relative to the upper nozzle body 402.

With the nozzle shaft 420 positioned in the center of the upper nozzle body 402 and generally supported by the inner spider support 406 and the lower nozzle shaft exit hole 312 as described above, and with the deflector plate 422 attached to the top of the nozzle shaft 420, and because the diameter of the top of the deflector plate 422 may be less than the diameter of the upper rim of the upper nozzle body 402, the deflector plate 422 may be positioned inside the top of the upper nozzle body 402 or above the upper nozzle body 402 depending on the position of the nozzle shaft 420. As noted earlier, the movement up and down of the deflector plate 422 relative to the top edge of the upper nozzle body 402 may affect the shape of the output water display. Alternatively, upper nozzle body 402 may be moved relative to deflector plate 422 to adjust the expression of water.

In addition, the annular gap between the deflector plate 422 and the upper nozzle body 402, may also influence the shape of the output water display. Therefore, different deflector plates 422 with different diameters, and different upper nozzle bodies 402 with different inner diameters may be chosen depending on the desired output water display. This will also be discussed in more detail in later sections.

The bloom nozzle movement control assembly 500 will now be described with reference to FIGS. 27, 28, 29, 30, 31A, 31B and 32. As described above and as shown in FIG. 27, the nozzle shaft 420 may pass through a lower nozzle shaft exit hole 312 in the bottom of the main elbow 310 such that it may engage with the bloom nozzle movement control assembly 500 that may be located within the electronics enclosure 202 underneath the electronics enclosure top plate 204. As shown in FIG. 28, the bloom nozzle movement control assembly 500 may include a motor 516, a motor mount 518, a cam 502, a cam follower 504, a cam follower support plate 506, a cam follower guide disc 510, a cam follower bearing 512, a cam follower guide bolt 514 as well as other components described below.

Figure 29:
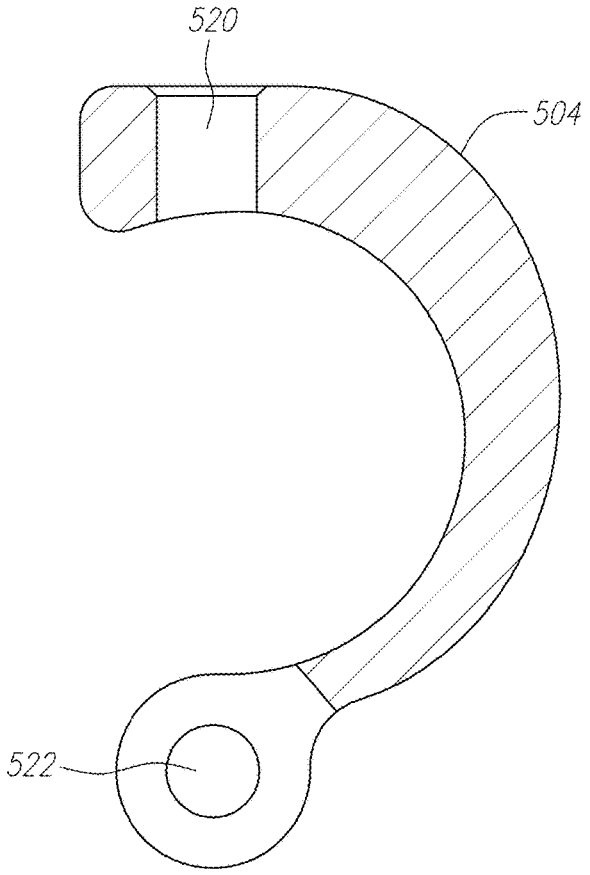
FIG. 29 is a side cross sectional view of a cam follower.

The nozzle shaft 420 may engage with the bloom nozzle movement control assembly 500 by attaching to the top of the cam follower 504. Cam follower 504 as shown in FIG. 29 may include a top hole 520 that may engage the lower end of the nozzle shaft 420. Accordingly, the lower end of the nozzle shaft 420 may be pressure fit and locked within the hole 520 or the lower end of the nozzle shaft 420 and the hole 520 may be complimentarily threaded such that the lower end of the nozzle shaft 420 may be screwed into the hole 520 on the top of the cam follower 504. The lower end of the nozzle shaft 420 may also be attached to the top of the cam follower 504 by other means such as welding methods, bolts, screws, clamps or other means.

Figure 27:
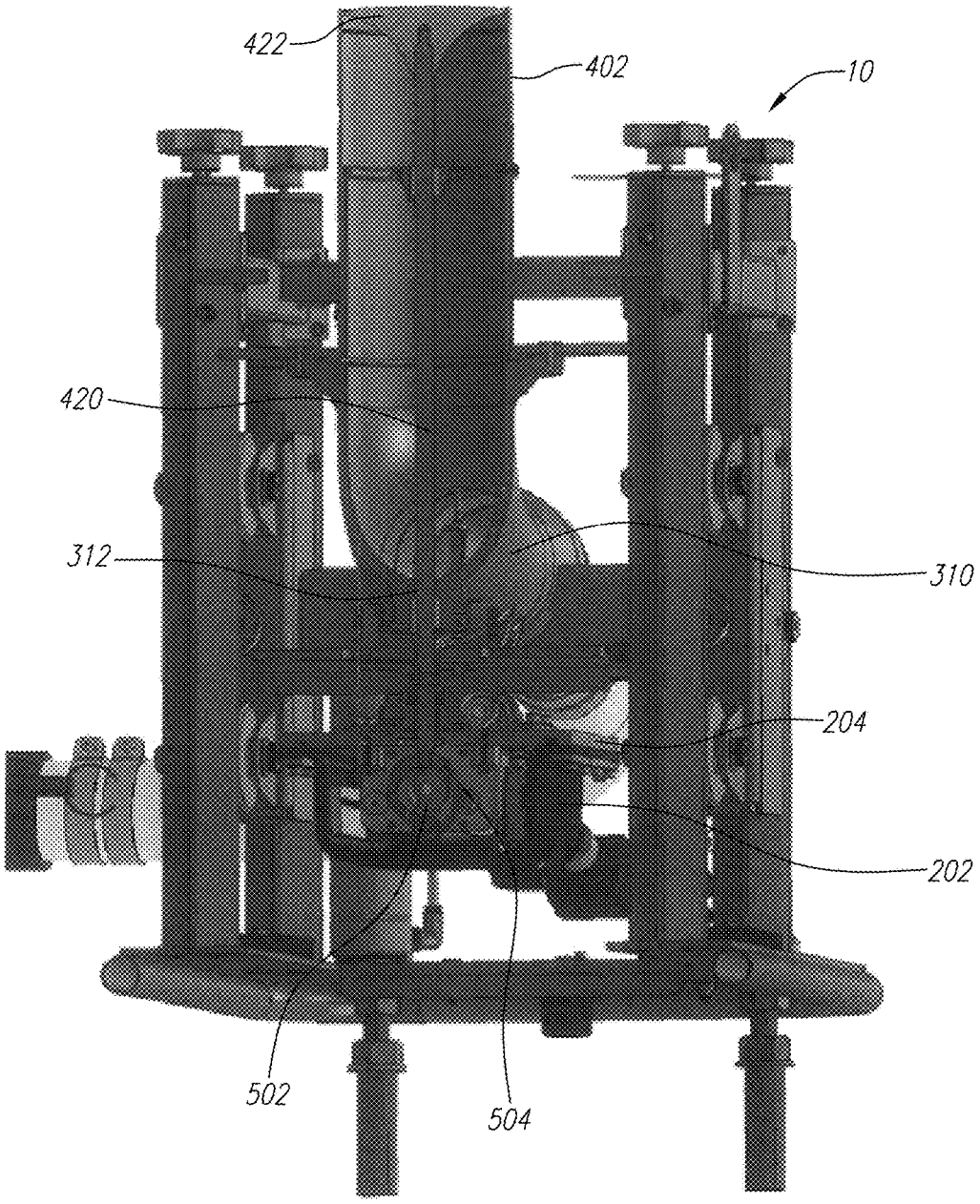
FIG. 27 is a side cut out view of a water delivery device.
Figure 28:
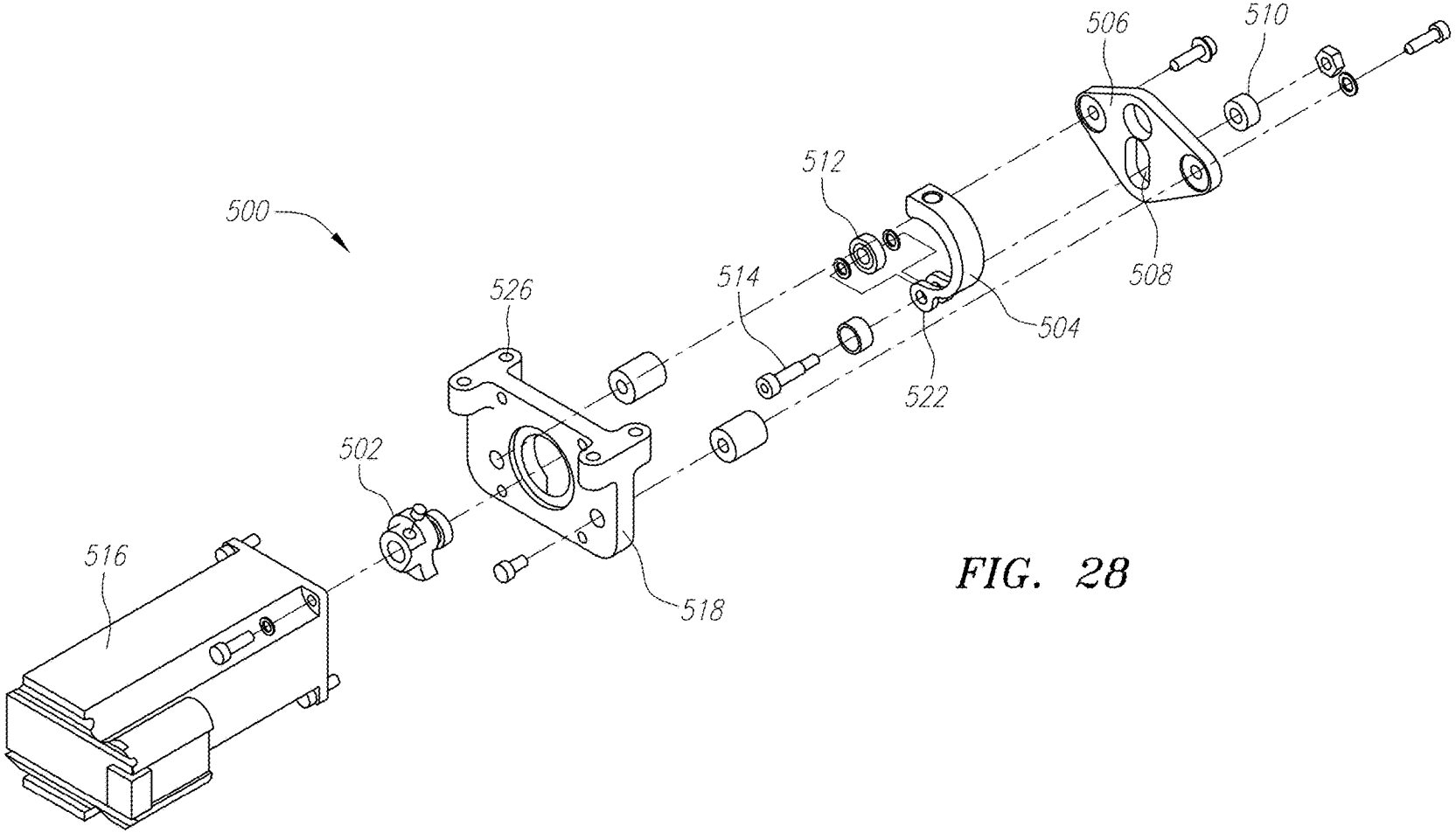
FIG. 28 is an exploded view of bloom nozzle control assembly.
Figure 31B:
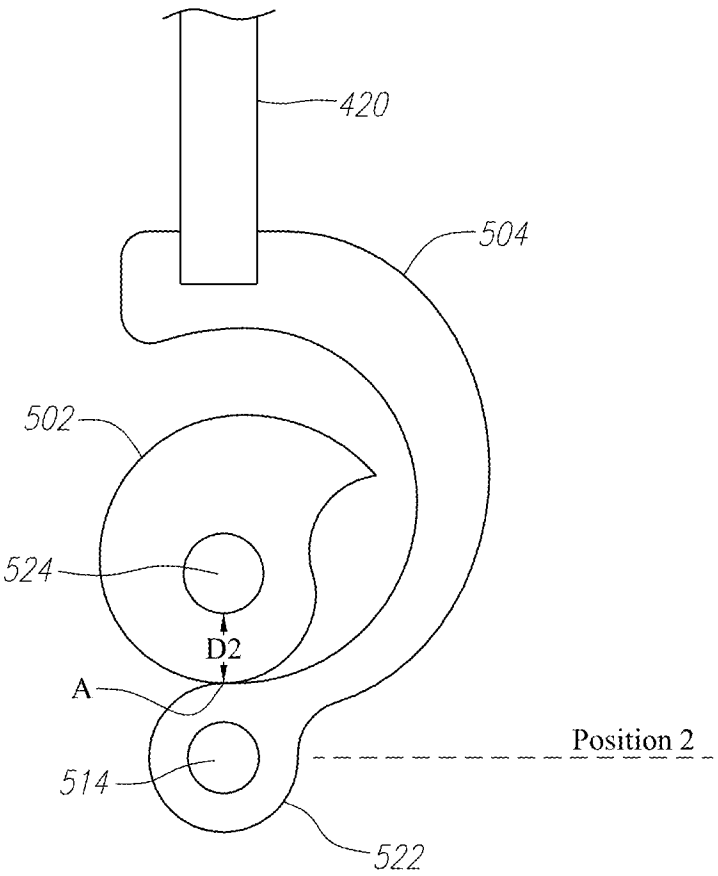
FIG. 31B is a side view of a cam and cam follower mechanism.
Figure 31A:
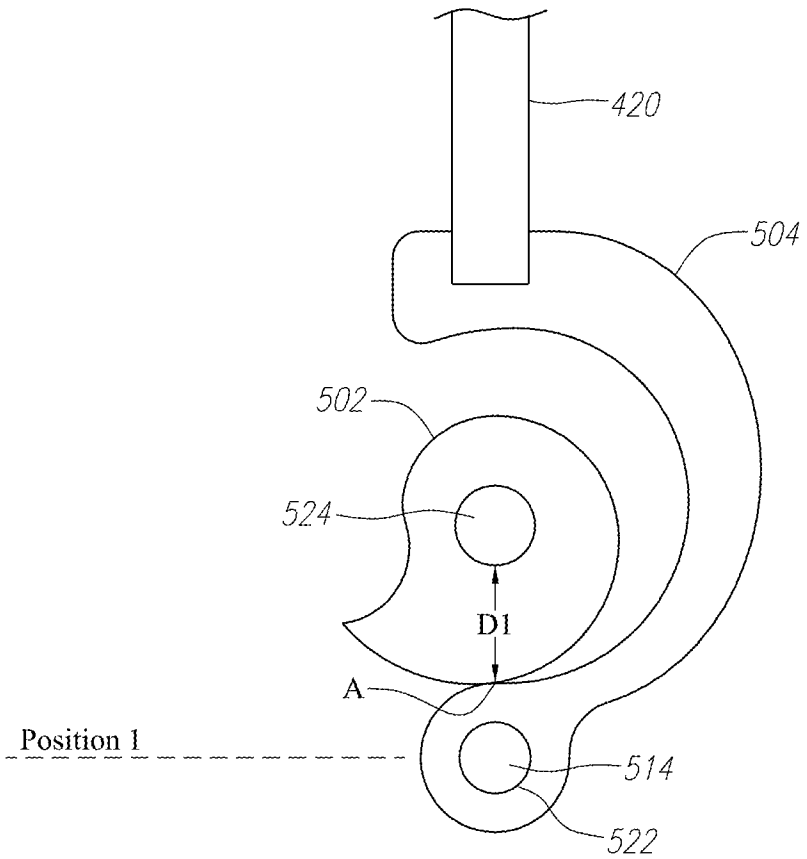
FIG. 31A is a side view of a cam and cam follower mechanism.
Figure 32:
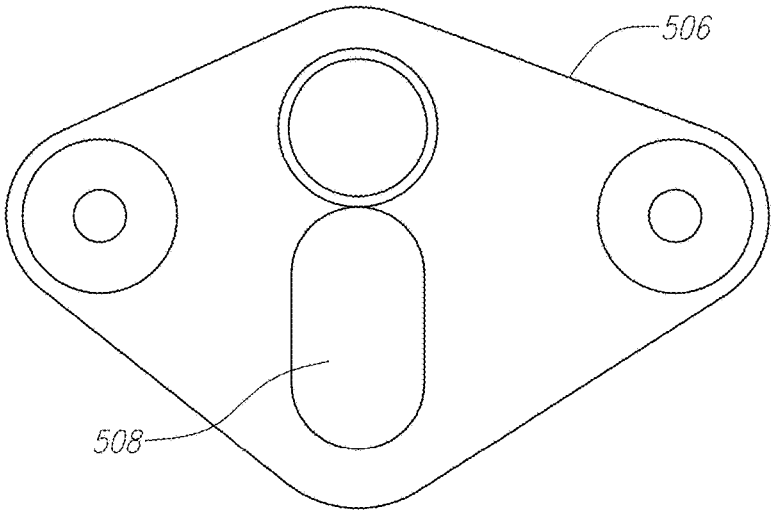
FIG. 32 is a side view of a cam follower support plate.

As shown in FIG. 27, FIG. 31A and FIG. 31B, the cam follower 504 may generally encircle a portion of cam 502, and may engage cam 502 at a point A located generally at the bottom of the cam 502. While the contact position A of the cam follower 504 to the cam 502 is shown to be generally at the bottom of the cam 502, other contact positions along the cam 502 may be utilized. Cam 502 may include a center drive pin 524 that may engage with the motor 516, and motor 516 may have the ability to radially turn and generally rotate center drive pin 524 in both clockwise and counter clockwise directions. Cam 502 may be fixedly attached to the center drive pin 524 by a pressure fit or through the use of lock nuts, screws, welding methods or other attachment means. Accordingly, as motor 516 may radially turn center drive pin 524, cam 502 attached to center drive pin 524 may also be turned along its axis defined by the drive pin 524. Motor 516 may be a stepper or other type of movement motor. In addition, motor 516 utilize electric, hydraulic, pneumatic or other movement means to turn center drive pin 524.

Figure 30:
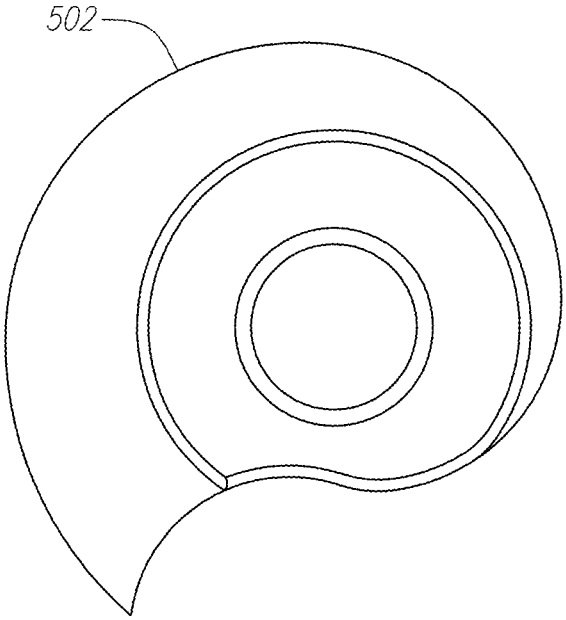
FIG. 30 is a top cross sectional view of a cam and lobe.

Cam 502 may have a lobe-shaped cross section as shown in FIGS. 30, 31A and 31B. Accordingly, the cross sectional diameter of cam 502 may vary radially along the lobe-shaped cross section. For example, dimension D1 in FIG. 31A being on a different radial point along the radial cross section of the cam 502 is shown to be less than dimension D2 in FIG. 31B. While FIGS. 30, 31A and 31B depict the cam 502 as having a lobe with radial dimensions that increase uniformly as the lobe tapers outward, other lobe shapes may also be employed.

While engaging cam 502, cam follower 504 may be supported by cam follower support plate 506, cam follower guide disc 510, cam follower bearing 512 and cam follower guide bolt 514. As shown in FIG. 29, cam follower 504 may have a support hole 522 positioned in its generally lower section that may house a cam follower bearing 512 that may engage a cam follower guide bolt 514. As show in FIG. 32, cam follower support plate 506 may have a generally vertical guide slot 508 that may be generally aligned with the cam follower support hole 522 as shown in FIG. 28. As shown in FIG. 28, cam follower guide bolt 514 may pass through the cam follower support hole 514, through the cam follower bearing 512 and through the guide slot 508 on the cam follower support plate 506. Cam follower guide discs 510 may be positioned on either side of the cam follower 504 and may assist in keeping the guide follower 504 aligned.

As shown in FIG. 28, guide follower support plate 506 may be fixedly attached to the motor mount plate 518 through use of bolts, screws or other attachment means. In addition, motor mount plate 518 may include upper bolt holes 526 that allow it to be fixedly attached to the underside of the electronics enclosure top plate 204 by means of bolts, screws or other attachment means. In addition, motor mount plate 518 may be bolted to or otherwise attached to the front or other section of the motor 516 thereby supporting the motor 516 within the electronics enclosure 202 as well. Motor 516 and motor mount plate 518 may also be supported within the electronics enclosure 502 by means of a support bracket, clamp or other support means.

By being fixedly attached to the motor mount plate 518, which in turn may be fixedly attached within the electronic enclosure 202, the guide follower support plate 506 may be held in a stable position. However, because the cam follower 504 may be held within the vertical guide slot 508, the cam follower 504 may be free to move transversely along the length of the slot 508 while being held secure in the other axis directions.

It should be noted that during operation of the water display device 10 as described in earlier sections, and with water passing through the water piping assembly 300 upward and out the top of the upper nozzle body 402 making forcible contact with the bottom surface area of the deflector plate 422, a continual upward force is exerted on the deflector plate 422 and thus on the nozzle shaft 420 connected to it. This upward force applied to nozzle shaft 420 may generally hold it in an upward position such that cam follower 504 to which it is attached is also held in a generally upward position.

Turning attention now to FIGS. 31A and 31B, FIG. 31A depicts the cam 502 to be in a radial position where the dimension from the center drive pin 524 to point A where the cam follower 504 makes contact with the lobe of the cam 502 is depicted as D1. In this position, the cam follower guide bolt 514 within the guide slot 508 (not shown) is depicted to be in position 1. Alternatively, FIG. 31B depicts the cam 502 to be in a radial position where the dimension from the center drive pin 524 to point A where the cam follower 504 makes contact with the lobe of the cam 502 is depicted as D2. In this position, the cam follower guide bolt 514 within the guide slot 508 (not shown) is depicted to be in position 2.

Because the dimension D1 is greater than dimension D2, position 1 of the follower guide bolt 514 in FIG. 31A is generally lower within the guide slot 508 (not shown) compared to position 2 in FIG. 31B. With position 2 of the follower guide bolt 514 being generally higher within the guide slot 508 (not shown), the cam follower 504 and thus the nozzle shaft 420 and deflector plate 422 that may be attached to it, may also be in a higher position when in position 2 compared to the position of these same components in position 1.

Thus, by rotating the cam 502 radially around the center drive pin 524, the motor 516 may be able to position the cam 502 in radial positions with varying dimensions between the center drive pin 524 and the point A where the cam may make contact with the cam follower 504 as depicted in FIG. 31A and FIG. 31B. With each radial position setting of the cam 502, the cam follower 504 may slide up or down within the guide slot 508 yet be held secure along its other axis by the cam follower support plate 506 and the cam follower guide bolt 514.

It is preferred that the guide slot 508 have dimensions large enough that allow the cam follower 504 to travel up and down within the guide slot 508 without hitting the ends of the slot for all radial settings of the cam 502. In this way, the motor 516 may be able to control the vertical setting of the nozzle shaft 420 and the deflector plate 422 within the bloom nozzle assembly 400 by radially rotating the cam 502.

It should be noted that using the movement control technique described above, the motor 516 may be capable of controlling the position of the bloom nozzle assembly 400 with great precision, and that very little vertical movement of the deflector plate 422 may be necessary to cause noticeable changes in the shape of the water display bloom. In any event, other mechanisms may be used to control the vertical position of deflector plate 422, and the scope of the current invention is not limited to the movement control technique discussed above.

Figure 33:
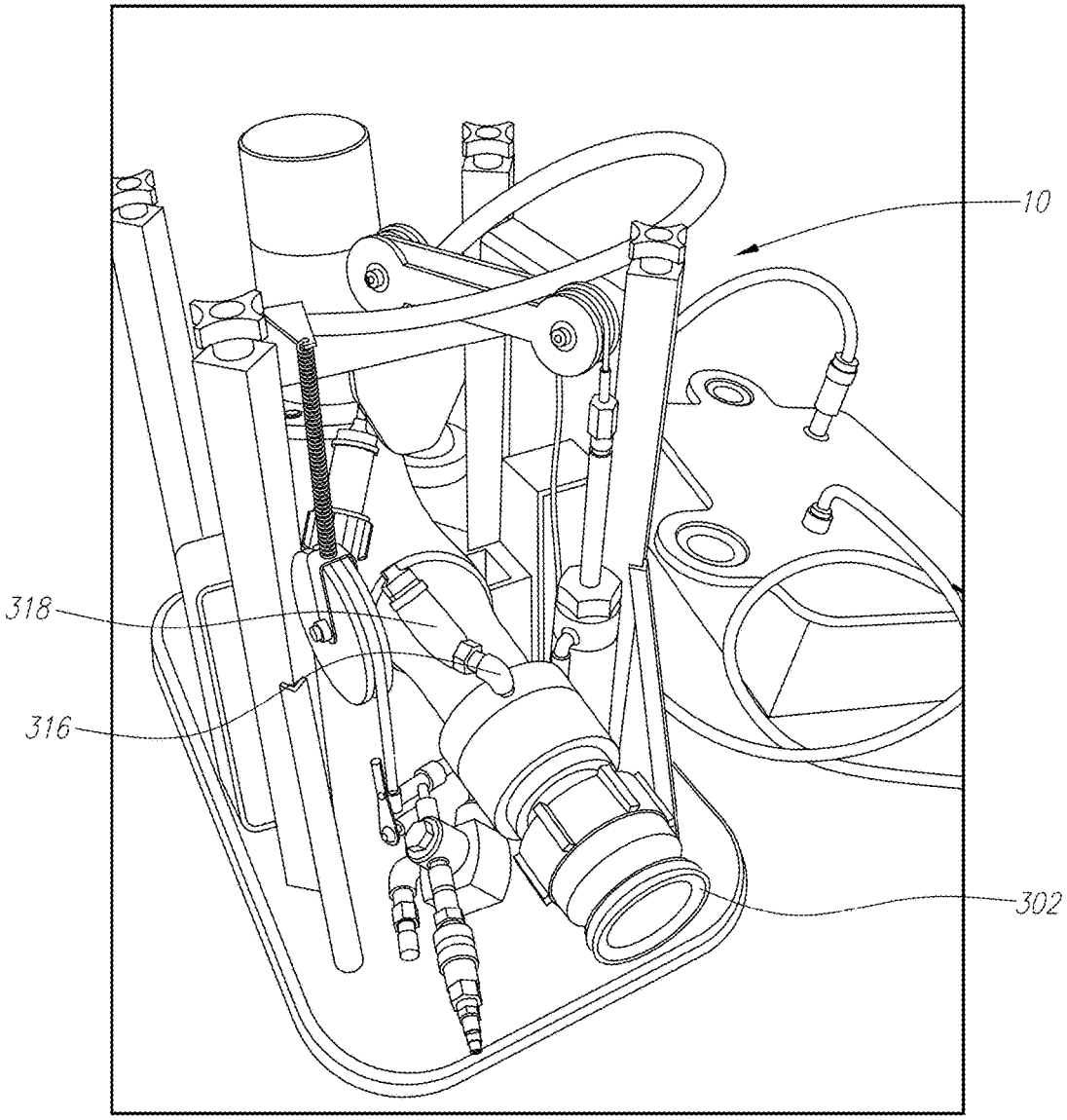
FIG. 33 is a perspective view of a water delivery device.

During operation of water display device 10, water may travel through the water piping assembly 300 and upper nozzle body 402 with great force, and may apply significant pressure to the bottom of the deflector plate 422, to the nozzle shaft 420 and to the bloom nozzle control assembly 500. To help counteract this force, the motor 516 may utilize hydraulic actuators and mechanisms to radially turn cam 502 in order to manipulate the position of the deflector plate 422. Due to the significant forces that may be applied to the deflector plate 422, motor 516 is preferably strong enough to overcome the significant upward forces applied to the deflector plate 422 while at the same time have the ability to set the position of the deflector plate 422 with great precision. FIG. 33 depicts water delivery device 10 equipped with a hydraulic boost assembly 318 that may supply additional hydraulic power to the motor 516 as necessary.

As shown in FIG. 33, hydraulic boost assembly 316 may include a bleed-off valve 316 that may pull water from the water input pipe 302 of the water piping assembly 300. The water that may be pulled from the water input pipe 302 may be redirected to the hydraulic actuator that may assist to power the motor 316 and control the radial movement of the cam 502. This water may be at high pressure due to the potentially high pressure of the water flowing into the water delivery device 10 through the input water pipe 302, and may thus provide additional hydraulic power to the motor 516 as necessary. The additional hydraulic power that may be provided by the hydraulic boost assembly 316 may assist motor 516 overcome the significant forces applied to the bloom nozzle control assembly 500 such that it may set the position of the deflector plate 422 with great precision.

In addition, the hydraulic boost assembly 316 may provide high pressure water to other hydraulic assemblies of the water delivery device 10 that may require additional power as necessary. For example, the hydraulic boost assembly 316 may provide additional hydraulic power to the pulley actuator 234 that may provide power to position the movable carriage assembly 200.

It is preferred that the bleed-off valve 316 is configured to not disturb the water flowing through the input water pipe 302 and into the water delivery device 10 so that it does not affect the general operation of the device 10. While FIG. 33 shows the bleed-off valve 316 as being located on the top of the input water pipe 302, the valve 316 may be located at other locations of the input water pipe 302 or at other locations along the water piping assembly 300.

It should also be mentioned that while this embodiment describes the bloom nozzle movement control assembly 500 as consisting generally of a cam/cam-follower based mechanism, other movement control mechanisms may be used.

The bloom nozzle movement control assembly 500 may be controlled by an automated computer controller, or may be controlled manually, or may be controlled by a combination of automated computer control and manual control.

Water display device 10 may also include sensors and feedback assemblies that may be placed within the water piping assembly 300, in the bloom nozzle assembly 400 or in other areas within the water display device 10 to monitor. These sensor and feedback assemblies may provide data to the computer controller such as water flow pressure, water flow velocity as well as other fluid dynamic measurements from within the water display device 10. In one embodiment, water flow pressure and water flow velocity sensors may be placed at the input to the water piping assembly 300 and at the output of the bloom nozzle assembly 400 to monitor these parameters at the general input to the water display device 10 and at the general output of the water display device respectively. By monitoring the input and output water flow parameters, the controller may be able to calculate the correlation coefficients between the measured input flow parameters and the output flow parameters and use this correlation data to maintain the necessary input flow parameters to achieve the desired output flow parameters.

In addition, motor 516 may provide cam position setting data to the controller so that the controller may be able to calculate the correlation coefficients between the cam position settings and the output bloom shape and thus the vertical position of the deflector plate 422 for each desired shape.

Accordingly, the controller may use the feedback data from the water sensors and feedback assemblies, the cam position data from the motor 516, and the calculated correlation coefficients as described above to set the input water pressure and the vertical position of the deflector plate 422 accordingly to obtain the desired bloom display effect and shape.

The shooting of water out of device 10 and the resulting visual effects are now further described. As mentioned above, the vertical position of deflector plate 422 in relation to outlet 402, the size of the annular gap therebetween, the thinness of plate 422 along its circumference and the precision with which plate 422 may be positioned, may all influence the configuration and/or expression of water shot out of device 10.

In connection with development of the current invention, it has been seen that slight movements in the vertical position of disk 422 may significantly change the configuration and/or expression of water shot out of device 10. Accordingly, it is preferred that small adjustments be made when varying the configuration and/or expression of the water from a column, hollow tube or bloom, or between a solid column, hollow column, cone or bloom (of varying angle), disk of water, and/or downward cone or bloom (of varying angle). The adjustment of the relative positions of disk 422 and/or outlet 402 preferably provides for the transition between some or all of the foregoing expressions of water in a forward or reverse sequence.

When plate 422 is positioned at or below the top of outlet 402, the annular gap between plate 422 and outlet 402 is preferably small enough that water passing through does so under high pressure. The size of the annular gap also serves to focus the travel of the water upward. In this manner, a concentrated vertical tube or column may be produced. The column may appear as solid or hollow. The thinness of the plate 422 at the point where the water leaves outlet 402 may also serve to focus the water in an upward direction.

The shape of the water display may also be affected by the flow rate of the water through device 10. To this end, an increase in flow rate may result in a wider bloom, i.e., a cone having a varying angle, when the plate 422 is positioned above the top of outlet 402. Furthermore, the interplay between flow rate and vertical position of plate 422 may affect the visual effects provided by device 10.

Multiple water display devices 10 may be employed simultaneously within the same water reservoir or within separate water reservoirs that are located in somewhat close proximity. These multiple water displays may be positioned in rows, column, or in other shapes such as concentric circles or other desired shapes. The controller may simultaneously monitor the sensors and feedback assemblies of the multiple water display devices and control them all in a choreographed fashion to produce sequential blooms, dancing displays and other synchronized water effects across the various water display devices 10.

Although certain presently preferred embodiments of the invention have been described herein, it will be apparent to those skilled in the art to which the invention pertains that variations and modifications of the described embodiments may be made without departing from the spirit and scope of the invention.

What is claimed is:

1. A water delivery device for emitting a stream of water, comprising:

an assembly that includes an outlet pipe having an inner diameter and a top end and that is movable between a first position located below a surface of a body of water and a second position located so that the top end of the outlet pipe is above the surface of the body of water;

a mechanism coupled to the assembly that moves the assembly between the first position and the second position; and a disk that has a diameter which is less than the outlet pipe inner diameter, that is movable between a range of positions from within the outlet pipe to above the outlet pipe top end, and that includes a transition zone with a downwardly directed concave profile on the bottom of the disk;

wherein when the assembly is in the second position, the stream of water is emitted from the outlet pipe, the outlet pipe is stationary and the disk moves relative to the stationary outlet pipe;

wherein the appearance of the stream of water emitted from the outlet pipe top end is altered by the relative position of the disk and the outlet pipe top end; and wherein the transition zone alters the appearance of the water.

2. The water delivery device of claim 1:

wherein the appearance of the water transforms from a solid column of water, to a hollow tube of water, to outward expanding water as the disk moves from a position within the outlet pipe to a position above the top end.

3. The water delivery device of claim 1, further comprising a device that regulates the flow rate of water provided to the outlet pipe, and wherein the flow rate is regulated as the disk is moved relative to the outlet pipe.

4. The water shooter of claim 1, wherein the disk is movable based on software.

5. The water delivery device of claim 1, wherein the appearance of water emanating from the device transitions through at least one or all of the sequence of a solid column of water, to a hollow column of water, to outward expanding water, to a disk of water, to a downward cone of water.

6. The water delivery device of claim 5, wherein the sequence of the appearance of water occurs in a reverse sequence.

7. The water delivery device of claim 1, wherein the appearance of the water is an outward expanding cone when the disk is located at or above the top end.

8. The water delivery device of claim 7, wherein the angle of the cone is decreased when the disk is drawn down into the pipe.

9. The water delivery device of claim 7, wherein the configuration of the water provided by the water delivery device varies depending on the flow rate of water leaving the outlet pipe.

10. The water delivery device of claim 7, wherein the appearance of the outward expanding cone is adjusted by raising or lowering the disk to resemble an adjustable flower bloom.

11. The water delivery device of claim 1, the assembly further comprising:

a base mounted to a submerged surface; and a frame that is attached to the base and to the outlet pipe and that adjusts the height of the outlet pipe.

12. The water delivery device of claim 1, wherein the assembly includes a base that is coupled to a submerged bottom floor of a reservoir.

13. The water delivery device of claim 1, wherein the mechanism that moves the assembly includes at least one guide rail and a carriage that is movably coupled to the at least one guide rail.

14. The water delivery device of claim 1, wherein the outlet pipe has a bottom end to receive water to be emitted from the outlet pipe, and the water delivery device further includes an angled water conduit that is coupled to the bottom end of the outlet pipe and that provides water to the bottom end.

15. A water delivery device for emitting a stream of water, comprising:

an assembly that includes an outlet pipe having an inner diameter and a top end and that is movable between a first position located below a surface of a body of water and a second position located so that the top end of the outlet pipe is above the surface of the body of water;

a mechanism coupled to the assembly that moves the assembly between the first position and the second position; and a disk that has a diameter which is less than the outlet pipe inner diameter and that is movable between a range of positions from within the outlet pipe to above the outlet pipe top end;

wherein when the assembly is in the second position, the stream of water is emitted from the outlet pipe, the outlet pipe is stationary and the disk moves relative to the stationary outlet pipe; and wherein the appearance of the stream of water emitted from the outlet pipe top end is altered by the relative position of the disk and the outlet pipe top end; and wherein the disk is held in an upward position by the force of water traveling through the outlet pipe, and the disk includes a rod that is connected to a cam having a diameter that varies radially.

16. The water delivery device in claim 15, further comprising a device to automatically change the position of the disk.

17. A water delivery device for emitting a stream of water, comprising:

an assembly that includes an outlet pipe having an inner diameter and a top end and that is movable between a first position located below a surface of a body of water and a second position located so that the top end of the outlet pipe is above the surface of the body of water;

a mechanism coupled to the assembly that moves the assembly between the first position and the second position; and a disk that has a diameter which is less than the outlet pipe inner diameter, that is movable between a range of positions from within the outlet pipe to above the outlet pipe top end, and that includes a parabolic transition zone on the bottom of the disk;

wherein when the assembly is in the second position, the stream of water is emitted from the outlet pipe, the outlet pipe is stationary and the disk moves relative to the stationary outlet pipe;

wherein the appearance of the stream of water emitting from the outlet pipe top end is altered by the relative position of the disk and the outlet pipe top end; and wherein the transition zone alters the appearance of the water.

* * * * *